US008858254B2

(12) United States Patent
Ikari et al.

(10) Patent No.: US 8,858,254 B2
(45) Date of Patent: Oct. 14, 2014

(54) ELECTRIC CONNECTOR AND MANUFACTURING METHOD THEREOF

(75) Inventors: Hiroharu Ikari, Machida (JP); Hiroshi Wada, Machida (JP); Takaki Kurachi, Machida (JP)

(73) Assignee: Dai-Ichi Seiko Co., Ltd., Fushimi-ku (JP)

( * ) Notice: Subject to any disclaimer, the term of this patent is extended or adjusted under 35 U.S.C. 154(b) by 528 days.

(21) Appl. No.: 13/150,731

(22) Filed: Jun. 1, 2011

(65) Prior Publication Data

US 2012/0058679 A1 Mar. 8, 2012

(30) Foreign Application Priority Data

Sep. 8, 2010 (JP) ..... 2010-201439
Feb. 9, 2011 (JP) ..... 2011-026461

(51) Int. Cl.

| | |
|---|---|
| ***H01R 12/24*** | (2006.01) |
| ***H01R 12/65*** | (2011.01) |
| ***H01R 43/16*** | (2006.01) |
| ***H01R 12/59*** | (2011.01) |
| ***H01R 13/405*** | (2006.01) |
| ***H01R 43/20*** | (2006.01) |
| *H01R 43/24* | (2006.01) |
| *H01R 12/79* | (2011.01) |
| *H01R 4/02* | (2006.01) |

(52) U.S. Cl.

CPC ..... *H01R 12/592* (2013.01); *H01R 43/24* (2013.01); *H01R 12/79* (2013.01); *H01R 12/65* (2013.01); *H01R 43/16* (2013.01); *H01R 4/023* (2013.01); *H01R 13/405* (2013.01); *H01R 43/20* (2013.01); *H01R 12/594* (2013.01)

USPC ..... 439/492

(58) Field of Classification Search

CPC ..... H01R 12/594
USPC ..... 439/494, 499, 660, 492, 942
See application file for complete search history.

(56) References Cited

U.S. PATENT DOCUMENTS 3,573,719 A * 4/1971 Lightner ..... 439/494
3,634,806 A * 1/1972 Fergusson ..... 439/497

(Continued)

FOREIGN PATENT DOCUMENTS

JP 5-62733 3/1993
JP 2001-23717 1/2001

(Continued)

OTHER PUBLICATIONS

U.S. Appl. No. 13/286,619, filed Nov. 1, 2011, Ikari, et al.

*Primary Examiner* — Neil Abrams
(74) *Attorney, Agent, or Firm* — Oblon, Spivak, McClelland, Maier & Neustadt, L.L.P.

(57) ABSTRACT

To well prevent a conductive contact from being peeled off with a simple structure, a rear end portion of the conductive contact to which a cable-shaped signal transmission medium is coupled is directly held by a contact engaging part. Even when an external force due to so-called flapping or the like is added from the cable-shaped signal transmission medium to the conductive contact, the conductive contact is well prevented from being peeled off. Also, a guide inclined surface for positioning the cable-shaped signal transmission medium is provided at the contact engaging part, and the cable-shaped signal transmission medium can be stably mounted along the guide inclined surface of the contact engaging part, thereby easily and accurately performing operations at the time of mounting, such as positioning.

14 Claims, 15 Drawing Sheets

(56) References Cited

U.S. PATENT DOCUMENTS

| | | | | | |
|---|---|---|---|---|---|
| 3,748,631 | A * | 7/1973 | Brorein | 439/633 |
| 3,757,277 | A * | 9/1973 | Yamanoue et al. | 439/660 |
| 4,074,929 | A * | 2/1978 | Krider | 439/398 |
| 4,264,118 | A * | 4/1981 | Nijman | 439/400 |
| 4,579,404 | A * | 4/1986 | Lockard | 439/92 |
| 4,605,276 | A * | 8/1986 | Hasircoglu | 439/465 |
| 4,871,319 | A * | 10/1989 | Babow | 439/77 |
| 4,875,877 | A * | 10/1989 | Fleak et al. | 439/497 |
| 4,993,968 | A * | 2/1991 | Guletsky et al. | 439/492 |
| 5,030,138 | A * | 7/1991 | Capp et al. | 439/497 |
| 5,085,595 | A * | 2/1992 | Koegel et al. | 439/494 |
| 5,110,306 | A * | 5/1992 | Buck et al. | 439/497 |
| 5,120,235 | A * | 6/1992 | Kashiwa | 439/405 |
| 5,163,849 | A * | 11/1992 | Fogg et al. | 439/497 |
| 5,267,875 | A * | 12/1993 | Koegel et al. | 439/497 |
| 5,415,567 | A * | 5/1995 | Fusselman et al. | 439/394 |
| 5,673,480 | A * | 10/1997 | Buchheister et al. | 29/843 |
| 5,953,815 | A * | 9/1999 | Kaminski et al. | 29/860 |
| 5,980,308 | A * | 11/1999 | Hu et al. | 439/497 |
| 6,007,385 | A * | 12/1999 | Wu | 439/607.45 |
| 6,106,338 | A * | 8/2000 | Wu et al. | 439/660 |
| 6,129,581 | A * | 10/2000 | Lee | 439/497 |
| 6,139,372 | A * | 10/2000 | Yang | 439/701 |
| 6,203,376 | B1 * | 3/2001 | Magajne et al. | 439/607.44 |
| 6,217,374 | B1 * | 4/2001 | O'Sullivan | 439/499 |
| 6,273,749 | B1 * | 8/2001 | Yang | 439/497 |
| 6,364,702 | B1 * | 4/2002 | Mochizuki et al. | 439/579 |
| 6,386,926 | B1 * | 5/2002 | Lee | 439/736 |
| 6,390,852 | B1 * | 5/2002 | Wang | 439/607.48 |
| 6,585,528 | B1 * | 7/2003 | Lin et al. | 439/76.1 |
| 6,652,325 | B2 * | 11/2003 | Tharp et al. | 439/660 |
| 6,726,503 | B2 * | 4/2004 | Waddell et al. | 439/465 |
| 6,790,087 | B2 * | 9/2004 | Ho | 439/606 |
| 6,802,744 | B2 * | 10/2004 | Chiang | 439/701 |
| 6,905,366 | B2 * | 6/2005 | Yang | 439/607.15 |
| 7,040,918 | B2 * | 5/2006 | Moriyama et al. | 439/497 |
| 7,066,772 | B2 * | 6/2006 | Takahashi | 439/731 |
| 7,090,534 | B2 * | 8/2006 | Wu et al. | 439/607.41 |
| 7,104,834 | B2 * | 9/2006 | Robinson et al. | 439/495 |
| 7,270,571 | B1 * | 9/2007 | Huang et al. | 439/607.45 |
| 7,377,803 | B2 * | 5/2008 | Matsuoka | 439/497 |
| 7,462,065 | B1 * | 12/2008 | Zhao | 439/499 |
| 7,497,724 | B1 * | 3/2009 | Fong et al. | 439/497 |
| 7,510,425 | B2 * | 3/2009 | Kuo et al. | 439/493 |
| 7,758,374 | B2 * | 7/2010 | Yu et al. | 439/493 |
| 7,824,198 | B2 * | 11/2010 | Tanaka | 439/108 |
| 7,824,221 | B2 * | 11/2010 | Miyoshi | 439/607.41 |
| 7,824,234 | B2 * | 11/2010 | Kamata et al. | 439/752 |
| 7,896,689 | B1 * | 3/2011 | Su et al. | 439/497 |
| 8,021,187 | B2 * | 9/2011 | Tagawa et al. | 439/607.31 |
| 8,057,253 | B2 * | 11/2011 | Huang et al. | 439/499 |
| 8,100,729 | B2 * | 1/2012 | Chen et al. | 439/719 |
| 8,197,281 | B2 * | 6/2012 | Yang | 439/499 |
| 8,353,731 | B1 * | 1/2013 | Huang et al. | 439/701 |
| 2010/0055992 | A1 * | 3/2010 | Liu et al. | 439/733.1 |
| 2011/0034076 | A1 | 2/2011 | Tagawa et al. | |

FOREIGN PATENT DOCUMENTS

| | | |
|---|---|---|
| JP | 2002-134205 | 5/2002 |
| JP | 2007-123216 | 5/2007 |
| JP | 2009-43610 | 2/2009 |

* cited by examiner

ELECTRIC CONNECTOR AND MANUFACTURING METHOD THEREOF

BACKGROUND OF THE INVENTION

1. Field of the Invention

The present invention relates to an electric connector configured so that a terminal part of a cable-shaped signal transmission medium is coupled to a conductive contact mounted on an insulating housing, and method of manufacturing the electric connector.

2. Description of the Related Art

In general, connecting a cable-shaped signal transmission medium formed of a coaxial cable or the like to a circuit substrate side via an electric connector has been widely conducted. For example, an electric connector has been known with a structure in which a plug connector to which a terminal part of the cable-shaped signal transmission medium is coupled is inserted to fit in a receptor connector implemented on a circuit substrate side. This electric connector has a structure in which the terminal part of the cable-shaped signal transmission medium, such as a coaxial cable, is coupled by soldering or the like to an exposed surface of a conductive contact buried in an insulating housing of the electric connector.

The conductive contact buried in the insulating housing extends in an elongated shape from a rear end side portion to which the terminal part of the cable-shaped signal transmission medium is coupled to a front end portion toward a fitting-in counterpart connector side. Conventionally, to make the insulating housing and the conductive contact strongly mounted, a protruding contact engaging part is provided to the conductive contact itself, and a part of the insulating housing is covered with the contact engaging part to allow the conductive contact to be held by the insulating housing, thereby preventing peeling-off. Examples of providing a contact engaging part to the conductive contact in the manner as described above include a case in which the conductive contact is caused to protrude on both sides in a plate-width direction (refer to Japanese Unexamined Patent Application Publication No. 05-062733) and a case in which protrusions are provided in a forward direction orthogonal to a plate-width direction of the conductive contact (refer to Japanese Unexamined Patent Application Publication No. 2001-023717).

However, the contact engaging part for use in the conventional electric connector is disposed at a part to fit in a counterpart connector or near that part. Therefore, while it would be possible to prevent the conductive contact from being peeled off on a fitting-in part side with the counterpart connector, the rear end side portion of the conductive contact to which the cable-shaped signal transmission medium is connected is not sufficiently held. That is, although the conductive contact for use in the conventional electric connector has a structure of being held by the insulating housing, holdability of a connecting part of the cable-shaped signal transmission medium is not sufficient. Therefore, when an external force due to so-called flapping or the like is added via the cable-shaped signal transmission medium, the conductive contact may be disadvantageously peeled off from the insulating housing.

Moreover, the size of an electric connectors in recent years tend to be decreased, and the conductive contacts are arranged with narrow pitches. Therefore, as described above, in the conventional structure in which a contact engaging part is provided to the conductive contact itself, it is difficult to increase the amount of protrusion of the contact engaging part, and it is also difficult to increase the amount of engagement between the contact engaging part and the insulating housing in a width direction of the conductive contact to more strengthen the mounting between the conductive contact and the insulating housing.

The cited prior art are listed as follows.

Japanese Unexamined Patent Application Publication No. 05 (1993)-062733

Japanese Unexamined Patent Application Publication No. 2001-023717

SUMMARY OF THE INVENTION

Thus, an object of the present invention is to provide an electric connector in which a conductive contact can be more prevented from being peeled off with a simple structure, and method of manufacturing the electric connector.

To achieve the above object, in the present invention, in an electric connector configured so that a conductive contact buried in the insulating housing so as to be exposed to a surface of an insulating housing extends from a rear end portion where a terminal part of a cable-shaped signal transmission medium is coupled to a front end portion toward a fitting-in counterpart connector side, the insulating housing is provided with a contact engaging part covering at least a part of a surface of the conductive contact, the contact engaging part provided to the insulating housing is disposed so as to cover a rear end side portion of the conductive contact, the contact engaging part is provided with a guide inclined surface facing the cable-shaped signal transmission medium from both sides in a contact width direction perpendicular to an extending direction of the conductive contact to position the cable-shaped signal transmission medium, and the guide inclined surface is disposed on each of both sides of the cable-shaped signal transmission medium in a pair, and the paired guide inclined surfaces are formed so as to be separated from each other in a direction of rising from a cable mounting surface where the cable-shaped signal transmission medium is mounted.

According to this structure, even when an external force due to so-called flapping or the like is added from the cable-shaped signal transmission medium to the conductive contact via the cable-shaped signal transmission medium, the rear end side portion of the conductive contact to which the cable-shaped signal transmission medium is coupled is directly held by the contact engaging part provided to the insulating housing. Therefore, the conductive contact can be more prevented from being peeled off. Also, when the cable-shaped signal transmission medium is mounted, the cable-shaped signal transmission medium is stably mounted along the guide inclined surface of the contact engaging part. Therefore, operations at the time of mounting the cable-shaped signal transmission medium, such as positioning, can be easily and accurately performed.

Furthermore, since the contact engaging part is provided as a part of the insulating housing, for example, even when a fixing force of the conductive contact is increased, the plate width of the conductive contact is not increased, unlike the conventional technique. Therefore, a decrease in size of the entire electric connector or narrowing pitches of the conductive contacts can be excellently performed without interfering the fixing force of the conductive contacts.

Also, preferably, the guide inclined surface in the present invention has a maximum height (h) from the cable mounting surface where the cable-shaped signal transmission medium is mounted set larger than a diameter (r) of the cable-shaped signal transmission medium (h>r).

According to this structure, more than half of the outer diameter portion of the cable-shaped signal transmission medium is held by the contact engaging parts, thereby achieving an excellent holding power.

Furthermore, preferably in the present invention, the guide inclined surfaces are disposed so as to face each other with a predetermined distance (W) in the contact width direction, and a distance (W2, W5) between the guide inclined surfaces facing each other is set longer than an outer diameter (d, d') of the cable-shaped signal transmission medium at a position of the maximum height (h, h1) of the guide inclined surface from the cable mounting surface (W2>d, W5>d').

According to this structure, the cable-shaped signal transmission medium is easily inserted between the guide inclined surfaces facing each other, thereby bringing efficiency to the mounting operation.

Still further, the guide inclined surface in the present invention preferably has a first inclined surface rising so as to form a first tilt angle (θ1) with respect to the cable mounting surface and a second inclined surface extending to form a second tilt angle (θ2) with respect to the cable mounting surface from a rising end of the first inclined surface, and the second tilt angle (θ2) is set smaller than the first tilt angle (θ1) (θ2<θ1).

According to this structure, the first inclined surface is first raised in a more vertical state with respect to the cable mounting surface. Therefore, an arrangement relation along the cable-shaped signal transmission medium is achieved, thereby excellently positioning the cable-shaped signal transmission medium. Compared with the case in which the inclined surface is raised vertically, an area covering the surface of the conductive contact is increased. Therefore, even when the conductive contacts are arranged with narrow pitches, excellent holdability can be achieved.

Also, since the second inclined surface extends in a more horizontal state, the cable-shaped signal transmission medium can be received in a wider range at an initial stage of mounting thereby improving guidability at the time of mounting the cable-shaped signal transmission medium.

Still further, preferably in the present invention, a height (h') from the cable mounting surface to the rising end of the first inclined surface is set longer than a diameter (r) of the cable-shaped signal transmission medium (h'>r).

According to this structure, more than half of the outer perimeter portion of the cable-shaped signal transmission medium is held by the first inclined surface, thereby well holding the cable-shaped signal transmission medium.

Still further, the conductive contact in the present invention preferably has a terminal edge part provided at a rear end portion of the conductive contact in the extending direction, the terminal edge part being disposed within a range in which the contact engaging part extends.

According to this structure, since the contact engaging part is adjacently disposed over the entire length of the rear end portion including the terminal edge part of the conductive contact, a contact between the terminal edge part of the conductive contact and another member can be avoided, and electrical insulation can be excellently achieved. Also, when a plurality of conductive contacts are collectively and integrally formed and then the terminal edge part of each conductive contact is cut out, the cut-out portion is more reliably interposed by the contact engaging parts, thereby improving efficiency in manufacturing conductive contacts.

Still further, preferably in the present invention, the conductive contact has a dimension in the contact width direction perpendicular to the extending direction, the dimension narrowed at a terminal edge part provided at a rear end portion of the conductive contact in the extending direction, and a terminal width (t1) of the narrowed conductive contact is formed so as to be shorter than a minimum width (W1) between the contact engaging parts on the cable mounting surface where the cable-shaped signal transmission medium is mounted (t1<W1).

According to this structure, the conductive contact can be easily cut out at the terminal edge part provided at the rear end portion of the narrowed conductive contact. Therefore, collective manufacture can be made with the terminal edge part being coupled to another conductive contact, thereby improving productivity.

Still further, preferably in the present invention, a distance between the adjacent guide inclined surfaces has a minimum width (W1, W4) along the cable mounting surface where the cable-shaped signal transmission medium is mounted, and the minimum width (W1, W4) is set shorter than an outer diameter (d, d') of the cable-shaped signal transmission medium (W1<d, W4<d').

According to this structure, the cable-shaped signal transmission medium is more accurately positioned. Therefore, even when the conductor contacts are arranged with narrow pitches, similar operation and effect can be achieved.

Still further, in the present invention, the guide inclined surface can be formed so as to entirely or partially cover the conductive contact, and the cable-mounting surface can be formed of a part of the conductive contact or the insulating housing between the paired guide inclined surfaces disposed on both sides of the cable-shaped signal transmission medium.

Also, in the present invention, the guide inclined surface can be formed so as to partially cover a surface of the conductive contact in a width direction, each of the paired guide inclined surfaces can be formed so as to cover a side end edge portion of the conductive contact interposed between the guide inclined surfaces, and the paired guide inclined surfaces can be integrally coupled by a part of the insulating housing, and the cable mounting surface is formed of a part of the insulating housing integrally coupling the guide inclined surfaces.

Furthermore, according to this structure, preferably in the present invention, with the guide inclined surface being formed so as to entirely cover the surface of the conductive contact, the cable mounting surface is formed so as to be a part of the guide inclined surface, and the rear end part of the conductive contact is buried inside the insulating housing having the guide inclined surface.

As such, even when the structure is adopted in which the guide inclined surface covers all or part of the surface of the conductive contact in a width direction, the conductive contact is more prevented from being peeled off. For example, when a space for disposing the conductive contact is narrowed as adjacent cable-shaped signal transmission media are disposed with narrow pitches, the fixing means protruding outwardly from the end edge part of the conductive contact in a width direction cannot be provided, and there is a possibility of decreasing a strength of holding the conductive contact. However, in the present structure, the rear end portion of the conductive contact is buried inside the insulating housing, all of the conductive contacts can be held with a sufficient strength, thereby more preventing the conductive contact from being peeled off.

Still, preferably in the present invention, the guide inclined surface extends in a direction of rising from the cable mounting surface so as to form a flat-shaped or concave-shaped curved surface.

In this structure, a flat guide inclined surface allows a quick operation of guiding a cable-shaped signal transmission medium, and a concave curved guide inclined surface increases a contact area with a cable-shaped signal transmission medium to allow stable support.

Still further, preferably, the guide inclined surface in the present invention is continuously provided with an introduction guide surface rising from an end edge part of the guide inclined surface in a direction approximately perpendicular to the cable mounting surface.

According to this structure, when a cable-shaped signal transmission medium is set, the cable-shaped signal transmission medium first makes contact with the introduction guide surface for basic positioning, thereby smoothly performing an operation of mounting the cable-shaped signal transmission medium.

Still further, in the present invention, the cable-shaped signal transmission medium can be formed of a twin coaxial cable with a set of two fine-line cables being taken as one cable, and the contact engaging part can be provided with a separation guide piece for guiding each of the set of two fine-line cables in a branching manner toward each of the adjacent conductive contact, the separation guide piece extending in the extending direction of the conductive contact.

According to this structure, when the cable-shaped signal transmission medium formed of a twin coaxial cable is mounted, each fine-line cable is positionally regulated by the separation guide piece so as to extend in a scheduled direction, thereby efficiently and accurately mounting the twin coaxial cable.

Still further, in the present invention, in a method of manufacturing an electric connector in which a conductive contact buried so as to be exposed to a surface of an insulating housing is disposed so as to extend from a rear end portion where a terminal part of a cable-shaped signal transmission medium is coupled to a front end portion toward a fitting-in counterpart connector side, the method of forming a contact engaging part covering both side parts in a width direction perpendicular to an extending direction of the conductive contact, the method includes the steps of forming a terminal edge part at the rear end portion of the conductive contact with a dimension in the width direction being narrowed and forming in advance a terminal width (t1) representing a width-direction dimension of the terminal edge part so that the terminal width is shorter than a minimum width (W1) between the contact engaging parts that are adjacent in a pair in the width direction (t1<W1), burying the conductive contact in the insulating housing, with the terminal edge part of the conductive contact with narrowed terminal width (t1) being disposed within a range where the contact engaging part extends; and then cutting the conductive contact at the terminal edge part.

According to this structure, even when an external force due to so-called flapping or the like is added from the cable-shaped signal transmission medium to the conductive contact via the cable-shaped signal transmission medium, the rear end side portion of the conductive contact to which the cable-shaped signal transmission medium is coupled is directly held by the contact engaging part provided to the insulating housing. Therefore, the conductive contact can be more prevented from being peeled off. Also, when the cable-shaped signal transmission medium is mounted, the cable-shaped signal transmission medium is stably mounted along the contact engaging part. Therefore, operations at the time of mounting the cable-shaped signal transmission medium, such as positioning, can be easily and accurately performed.

Furthermore, since the contact engaging part is adjacently disposed over the entire length of the rear end portion including the terminal edge part of the conductive contact, a contact between the terminal edge part of the conductive contact and another member can be avoided, and electrical insulation can be excellently achieved. Also, when a plurality of conductive contacts are collectively and integrally formed and then the terminal edge part of each conductive contact is cut out, the cut-out portion is more reliably interposed by the contact engaging parts, thereby improving efficiency in manufacturing conductive contacts.

Still further, the narrowed conductive contact can be easily cut out at its terminal edge part. Therefore, for example, terminal contacts can be excellently produced even after they are collectively manufactured with the terminal edge part of one conductive contact being coupled to another conductive contact, thereby improving productivity. Still further, the cable-shaped signal transmission medium is more accurately positioned. Therefore, productivity can be improved even when the conductive contacts are arranged with narrow pitches.

As described above, in the present invention, the rear end side portion of the conductive contact to which the cable-shaped signal transmission medium is coupled is directly held by the contact engaging part provided to the insulating housing. Even when an external force due to so-called flapping or the like is added from the cable-shaped signal transmission medium to the conductive contact via the cable-shaped signal transmission medium, the conductive contact can be well prevented from being peeled off. The contact engaging part is provided with guide inclined surfaces facing the cable-shaped signal transmission medium, with an upper part open, from both sides in a contact width direction perpendicular to the extending direction of the conductive contact, the guide inclined surfaces for positioning the cable-shaped signal transmission medium. The cable-shaped signal transmission medium can be stably mounted along the guide inclined surfaces of the contact engaging parts. Therefore, operations at the time of mounting, such as positioning, can be easily and accurately performed. Furthermore, a decrease in size of the entire electric connector or narrowing pitches of the conductive contacts can be excellently performed without interfering the fixing force of the conductive contacts. Thus, the conductive contact can be well prevented from being peeled off with a simple structure, and a decrease in size or height of the electric connector can be excellently performed, and reliability of the electric connector can be significantly increased with low cost.

DETAILED DESCRIPTION OF THE PREFERRED EMBODIMENTS

Embodiments of the present invention are described in detail below based on the drawings.

Electric Connector Assembly in First Embodiment

An electric connector according to an embodiment (a first embodiment) of the present invention depicted in FIG. 1 to FIG. 11 is formed of a plug connector 10 where fine-line cables SC as a cable-shaped signal transmission medium are coupled. The plug connector 10 according to the invention where a terminal portion of the fine-line cables SC is coupled is configured to be inserted to fit in a counterpart-side connector (such as a receptacle connector) solder-connected to a wiring pattern on a printed wiring board not shown along the surface of the printed wiring board.

In the following, an extending direction of the surface of the printed wiring board in which the plug connector 10 according to an embodiment of the present invention is inserted to fit is referred to as a "horizontal direction", and a direction perpendicular to the surface of the printed wiring board is referred to as a "height direction". Also, an end edge part in a direction of inserting the plug connector 10 at the time of fit-in is referred to as a "front end edge part" and an en edge part on an opposite side is referred to as a "rear end edge part".

The plug connector 10 according to the present embodiment has a shape of extending long toward one direction, and the long-length extending direction is referred to as a "connector longitudinal direction". A plurality of fine-line cables SC described above are configured to be adjacently arranged so as to form a multipolar shape along the "connector longitudinal direction".

Plug Connector

A connector body part of the plug connector 10 configuring an electric connector on one side of an electric connector assembly has an insulating housing 11 formed of an insulating material, such as a synthetic resin, and includes a conductive shell 12 as a connector cover covering an outer surface of the insulating housing 11 to interrupt electromagnetic wave noise from outside and others. The conductive shell 12 in the present embodiment is configured to be inserted so as to interpose the insulating housing 11 from above and below.

Also, in the insulating housing 11 configuring the connector body part of the above-described plug connector 10, a plurality of conductive contacts 13 are arranged at appropriate pitch spacing so as to form a multipolar shape along the connector longitudinal direction. Each of these conductive contacts 13 is formed by bending a metal material in an elongated thin plate shape with elasticity, is buried in the insulating housing 11 so as to extend in a fore-and-aft direction (a vertical direction in FIG. 5), and is arranged so as to be exposed to an upper surface of the insulating housing 11. Each of the conductive contacts 13 in the present embodiment is formed so that adjacent ones form an approximately same shape.

Figure 1:
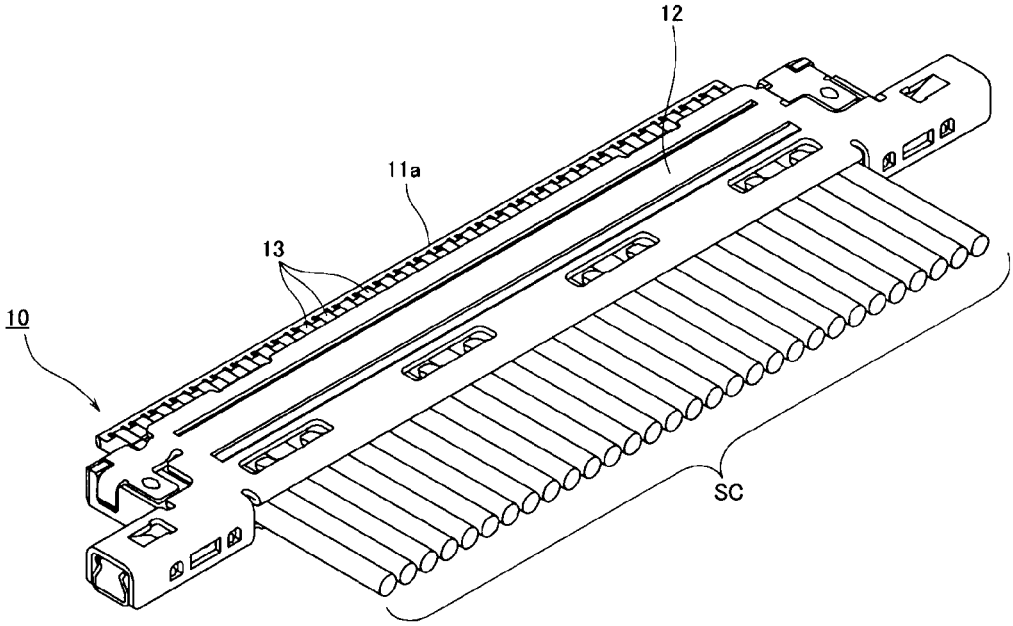
FIG. 1 is an external perspective view for describing a state in which a terminal part of a cable-shaped signal transmission medium (cables) is coupled to a plug connector according to a first embodiment of the present invention.
Figure 2:
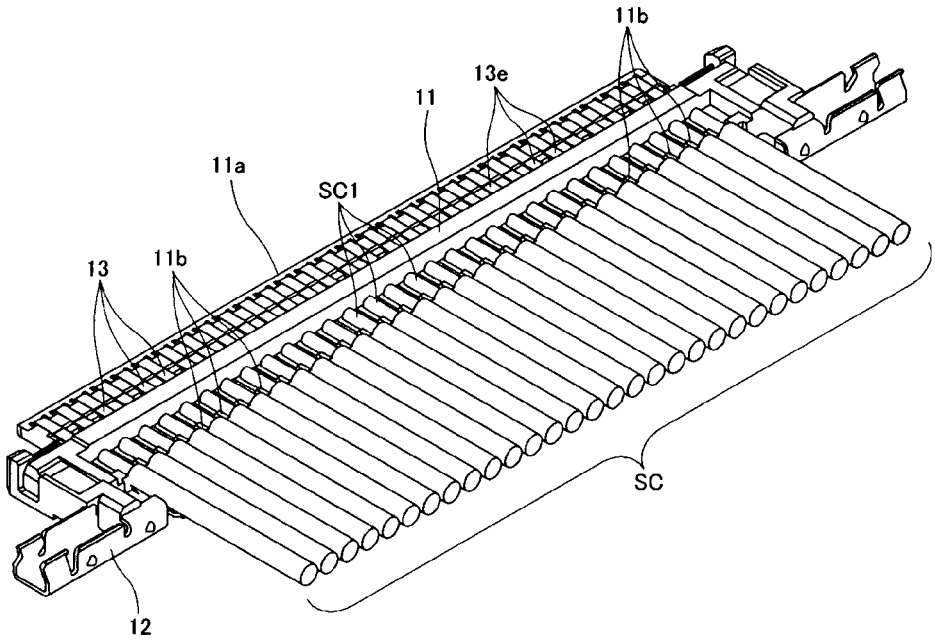
FIG. 2 is an external perspective view for describing a state changed from the state in FIG. 1, with a conductive shell on an upper side being removed.
Figure 3:
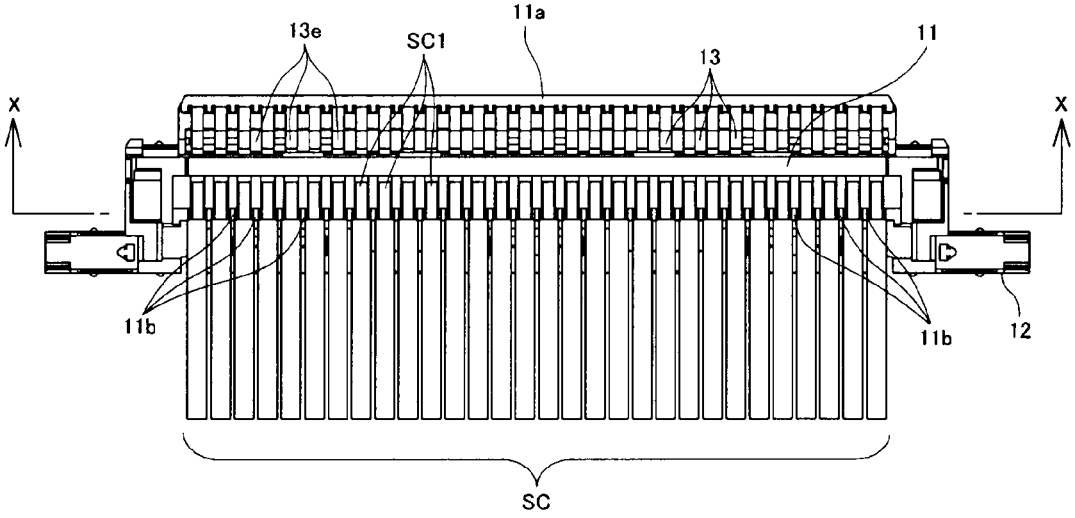
FIG. 3 corresponds to the plug connector depicted in FIG. 2, depicting a plan view for describing a state in which the conductive shell is removed on the upper side is removed.
Figure 4:
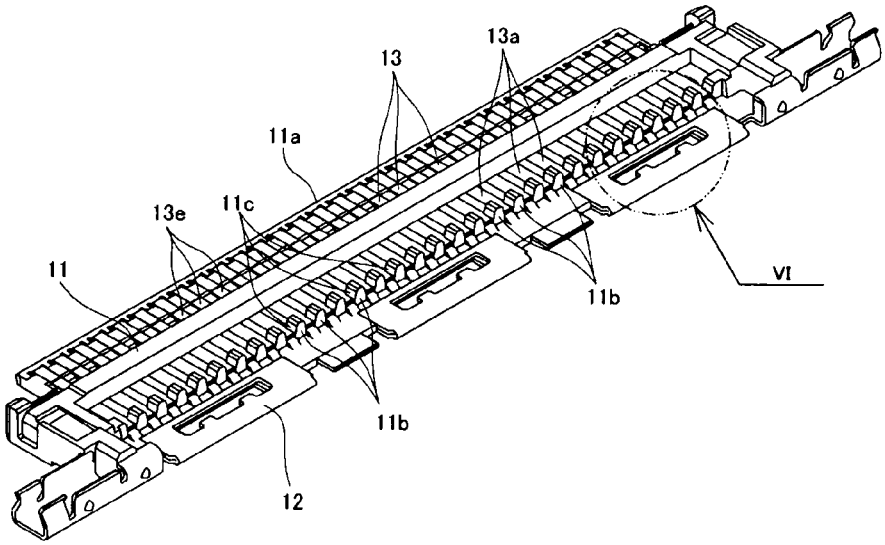
FIG. 4 is an external perspective view for describing a state changed from the state in FIG. 2 in which the conductive shell is removed, with the cable-shaped signal transmission medium (cables) being further removed.
Figure 5:
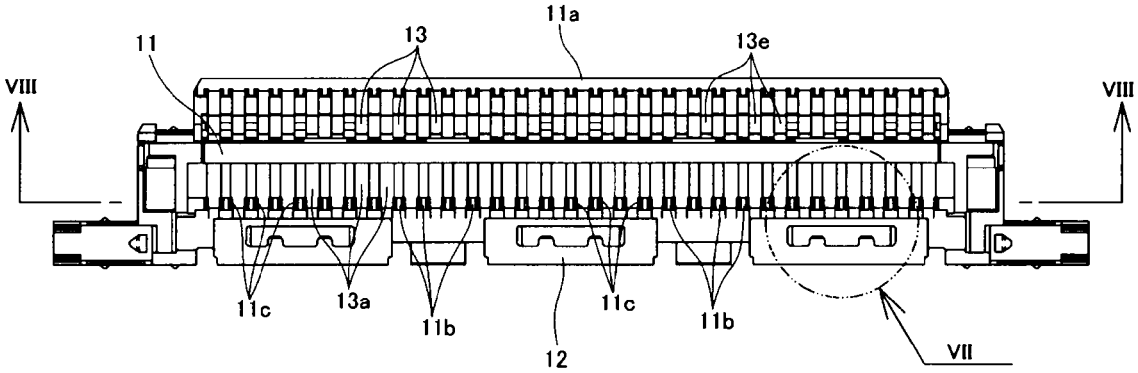
FIG. 5 is a plan view for describing the plug connector represented in FIG. 4.
Figure 6:
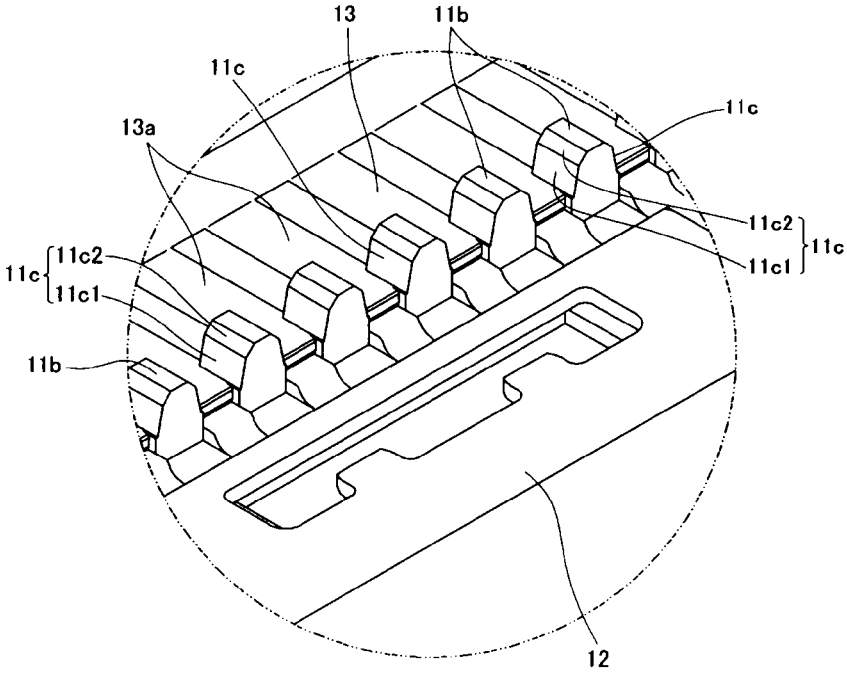
FIG. 6 is an external perspective view for describing a portion indicated by a reference character VI in FIG. 4 being enlarged.

On the other hand, the fine-line cables SC (a cable-shaped signal transmission medium) described above are electrically connected to a rear end side portion of each conductive contact 13 (a lower end side portion in FIG. 3). That is, each of the fine-line cables SC is configured to have a center conductor SC1 for signal transmission or grounding whose outer perimeter side surrounded by an insulating material, and is formed in a structure in which the center conductor SC1 in an exposed state with a terminal portion of the fine-line cable SC stripped protrudes forward. The center conductor SC1 is placed from above with respect to a rear end side portion (a lower end side portion in FIG. 5) of the conductive contact 13, and is solder-jointed in a contact-placement state. Here, solder jointing is collectively performed on all of those in a multipolar arrangement direction. The mounting and jointing relation of the fine-line cables (the cable-shaped signal transmission medium) with respect to the rear end side portion of the conductive contacts 13 will be described in detail further below as a main part of the present invention.

A front end edge part of the insulating housing 11 described above is provided with a fit-in convex part 11*a* to be inserted in the inside of the receptacle connector on a fit-in counterpart side so as to extend in a thin-plate shape along the connector longitudinal direction. When this fit-in convex part 11*a* of the plug connector 10 is inserted in the inside of the receptacle connector on a fit-in counterpart side, a conductive shell 12 on a plug connector 10 side makes contact with a conductive shell on a receptacle connector (not shown) side. With this contact between the conductive shells, a ground circuit for grounding is formed.

Figure 12:
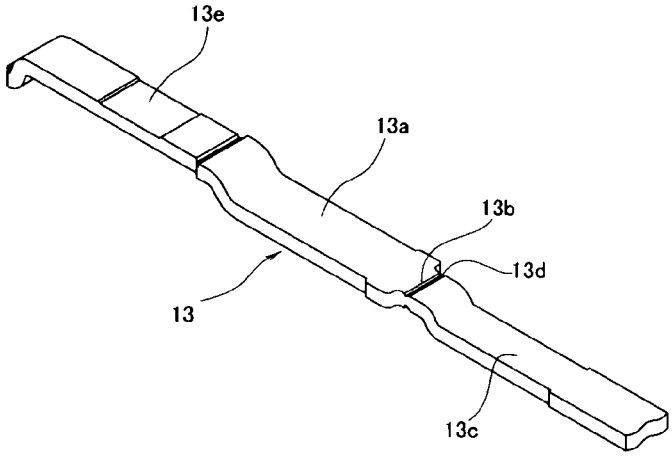
FIG. 12 depicts a single conductive contact for use in the plug connector depicted in FIG. 1 to FIG. 11, depicting an external perspective view for describing a state before a coupling carrier is cut out.

The fit-in convex part 11*a* provided at the front end edge part of the insulating housing 11 is provided so as to extend in a thin film shape along the connector longitudinal direction. On an upper surface of the fit-in convex part 11*a*, fit-in contact parts 13*e* (refer to FIG. 12) formed at a front end side portion (an upper end side portion in FIG. 5) of the conductive contacts 13 described above are arranged so as to form a multipolar electrode shape. The front end side portion of the conductive contacts 13 has its lower side portion excluding its upper surface buried in the insulating housing 11 by insert molding. Also, when the plug connector 10 fits in a receptacle connector (not shown), the upper surface of the conductive contacts 13 described above elastically makes contact with conductive contacts on a receptacle connector side, thereby forming a signal transmission circuit.

Next, a joint relation between the fine-line cables (cable-shaped signal transmission medium) SC and the rear end side portion of the conductive contacts 13 is described, which is a main part of the present invention. As described above, each conductive contact 13 is buried so as to be exposed to the upper surface of the insulating housing 11, and extends in an elongated shape in the fore-and-aft direction (the vertical direction in FIG. 5) from the rear end side portion where the terminal part of the center conductor SC1 of each fine-line cable SC is coupled to the front end side portion toward a receptacle connector as a fit-in counterpart. The surface exposed from the insulating housing 11 at the rear end side portion of the conductive contact 13 forms a cable mounting surface 13*a* where the fine-line cable SC is mounted from above.

Here, each of the conductive contacts 13 described above has a structure in which a part of the cable mounting surface 13*a* forming the exposed surface is covered and supported from above by a contact engaging part 11*b* integrally provided to the insulating housing 11. The contact engaging part 11*b* as a contact supporting part is disposed between ones of a plurality of conductive contacts 13, and is formed in a block shape rising so as to protrude upwardly from a position corresponding to the rear end side portion (a lower end portion in FIG. 5) of each conductive contact 13. As a specific shape of each contact engaging part 11, a shape is adopted in which an approximately trapezoidal sectional shape continues in a fore-and-aft direction (a vertical direction in FIG. 7).

The contact engaging parts 11*b* each have an arrangement relation in which a part of a bottom surface of the contact engaging parts 11*b*, more specifically, a both-side edge portion of the bottom surface in the connector longitudinal direction, covers, from above, a both-end edge portion of the rear end side portion (the lower end portion in FIG. 5) of each conductive contact 13 described above. With this arrangement structure of the contact engaging part 11*b*, the rear end side portion (the lower end portion in FIG. 5) of each conductive contact 13 can be stably supported without being peeled off from the insulating housing 11.

Also, in a portion between the adjacent contact engaging parts 11*b*, the center conductor SC1 of the fine-line cable SC as the cable-shaped signal transmission medium described above is inserted as being positionally regulated. That is, each contact engaging part 11*b* has a side surface part facing another adjacent contact engaging part 11*b*, and each side surface is formed as an inclined surface rising from the cable mounting surface 13*a* of the conductive contact 13 described above at a predetermined angle. Also, the inclined surface forming the side surface part of the contact engaging part 11*b* serves as a guide inclined surface 11*c* that positions the center conductor SC1 of the fine-line cable (the cable-shaped signal transmission medium) SC.

As such, the guide inclined surfaces 11*c* each provided on the side surface part of the contact engaging part 11*b* have an arrangement relation in which the guide inclined surfaces 11*c* face each other near an outer perimeter surface of the center conductor SC1 in the fine-line cable (the cable-shaped signal transmission medium) SC described above and the guide inclined surfaces 11*c* in a pair are provided on both sides of the center conductor SC1 of the fine-line cable SC in a diameter direction. Each of these guide inclined surfaces 11*c* is formed as an inclined surface with an upper open shape continuously spaced apart from another adjacent guide inclined surface 11*c* in a direction of rising upwardly from the cable mounting surface 13*a*.

Figure 11:
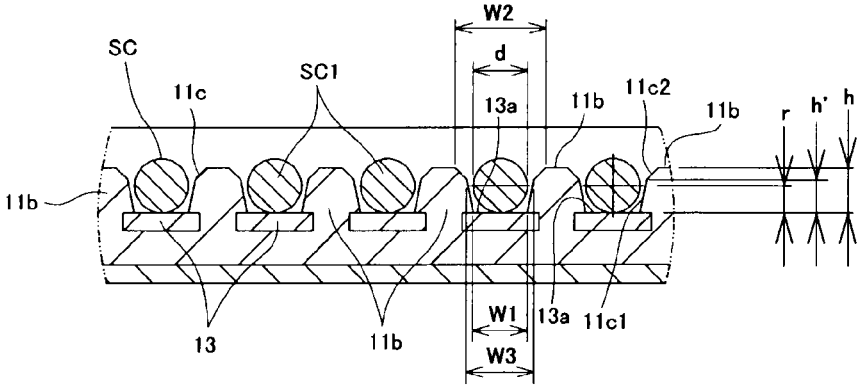
FIG. 11 is a longitudinal sectional view for describing a portion indicated by a reference character XI in FIG. 10 being enlarged.

As described above, a distance between the adjacent paired guide inclined surfaces 11*c* is continuously widened in a rising direction. In particular, as depicted in FIG. 11, the distance between the adjacent paired guide inclined surfaces 11*c* has a minimum width (W1) at a position along the surface of the cable mounting surface 13*a*. Also, the minimum width (W1) between the contact engaging parts 11*b* along the surface of the cable mounting surface 13*a* is set shorter than an outer diameter dimension (d) of the center conductor SC1 in the fine-line cable (the cable-shaped signal transmission medium) SC (W1<d).

Also, the distance between the paired guide inclined surfaces 11*c* described above has a maximum width (W2) at a position of a maximum height (h) rising from the cable mounting surface 13*a*. The maximum distance (W2) between the guide inclined surfaces 11*c* is set longer than the outer diameter dimension (d) of the center conductor SC1 of the fine-line cable (the cable-shaped signal transmission medium) SC (W2>d).

According to the present embodiment having the structure described above, the center conductor SC1 of the fine-line cable (the cable-shaped signal transmission medium) SC is easily received through a portion with the maximum width (W2) between the paired contact engaging parts 11*b*, and the center conductor SC1 is then inserted and mounted onto the cable mounting surface 13*a* as being smoothly guided along the surfaces of both of the guide inclined surfaces 11*c*. Thus, the operation of mounting the fine-line cables SC can be stably performed by using the contact engaging parts 11*b*. Therefore, operations at the time of mounting the fine-line cables SC, such as positioning, can be easily and accurately performed, bringing efficiency to the mounting operation.

Furthermore, as described above, the minimum width (W1) between adjacent paired contact engaging parts 11*b* along the surface of the cable mounting surface 13*a* is set shorter than the outer diameter dimension (d) of the center conductor SC1 of the fine-line cable (the cable-shaped signal transmission medium) SC (W1<d). Therefore, the fine-line cable SC can be more accurately positioned. Even when the conductor contacts 13 are arranged with narrow pitches, similar operation and effect can be achieved, thereby improving productivity.

Note that when the distance between adjacent paired guide inclined surfaces 11*c* is minimum on the cable mounting surface 13*a* and is set shorter than the center conductor SC1 of the fine-line cable (the cable-shaped signal transmission medium) SC (W1<d), at least a distance (W3) between the guide inclined surfaces 11*c* at the height position corresponding to a diameter (r) of the center conductor SC1 of the fine-line cable SC can be set larger than the outer diameter dimension (d) of the center conductor SC1 (W3>d).

Still further, even when an external force due to so-called flapping or the like is added from the fine-line cable SC to the conductive contact 13 via the fine-line cable (the cable-shaped signal transmission medium) SC, the rear end side portion of the conductive contact 13 to which the fine-line cable SC is coupled is directly held by the contact engaging part 11*b* provided to the insulating housing 11. Therefore, the conductive contact 13 can be prevented well from being peeled off.

Figure 9:
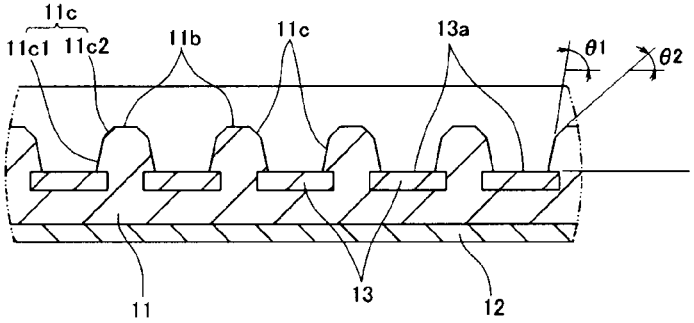
FIG. 9 is a longitudinal sectional view for describing a portion indicated by a reference character IX in FIG. 8 being enlarged.
Figure 10:
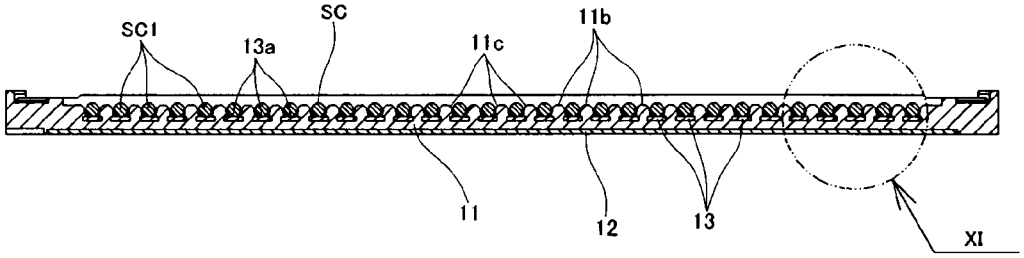
FIG. 10 is a longitudinal sectional view for description along a line indicated by a reference character X-X in FIG. 3.

Furthermore, as depicted particularly in FIG. 9 and FIG. 11, the guide inclined surface 11*c* of the contact engaging part 11*b* according to the present embodiment is configured to have two-step inclined surfaces in the rising direction. More specifically, the guide inclined surface 11*c* has a first inclined surface 11*c*1 rising at a first tilt angle (θ1) with respect to the cable mounting surface 13*a* described above and a second inclined surface 11*c*2 extending at a second tilt angle (θ2) with respect to the cable mounting surface 13*a* from a rising end (an upper end) of the first inclined surface 11*c*1. Also, the second tilt angle (θ2) is set to be smaller than the first tilt angle (θ1) (θ2<θ1).

With this structure, since the first inclined surface 11*c*1 first rises in a more vertical state with respect to the cable mounting surface 13*a*, the first inclined surface 11*c*1 has an arrangement relation more closer to the center conductor SC1 of the fine-line cable (the cable-shaped signal transmission medium) SC, thereby well positioning the fine-line cable SC. Also, since the second inclined surface 11*c*2 extends in a more horizontal state, the center conductor SC1 of the fine-line able SC can be received in a wider range at an initial stage of mounting, thereby improving guidability at the time of mounting the fine-line cable SC.

Still further, as depicted particularly in FIG. 11, in the guide inclined surface 11*c* provided to the contact engaging part 11*b* in the present embodiment, the maximum height (h) from the cable mounting surface 13*a* where the center conductor SC1 of the fine-line cable (the cable-shaped signal transmission medium) SC is mounted is set longer than the diameter (r) of the center conductor SC1 in the fine-line cable SC (h>r).

In the present embodiment having the structure described above, more than half of the outer diameter portion (d) of the center conductor SC1 in the fine-line cable (the cable-shaped signal transmission medium) SC is held by the contact engaging parts 11*b*, thereby achieving an excellent holding power for the fine-line cable SC Still further, in the present embodiment, as depicted particularly in FIG. 11, a height (h') from the cable mounting surface 13*a* described above to a rising end edge (an upper end edge) of the first inclined surface 11*c*1 of the guide inclined surface 11*b* is set longer than the diameter (r) of the center conductor SC1 in the fine-line cable (the cable-shaped signal transmission medium) SC (h'>r).

With this structure, more than half of the outer diameter portion (d) of the center conductor SC1 in the fine-line cable (the cable-shaped signal transmission medium) SC is held by the first inclined surfaces 11*c*1 thereby excellently holding the fine-line cable SC.

Figure 7:
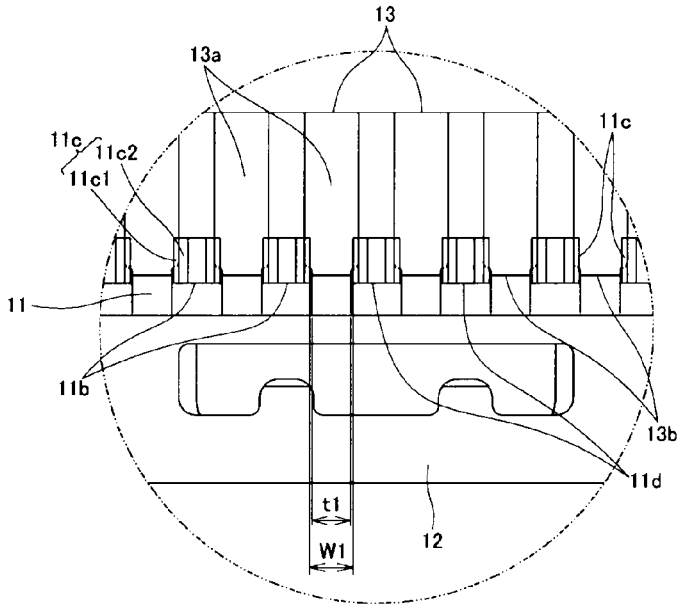
FIG. 7 is a plan view for describing a portion indicated by a reference character VII in FIG. 5 being enlarged.
Figure 8:
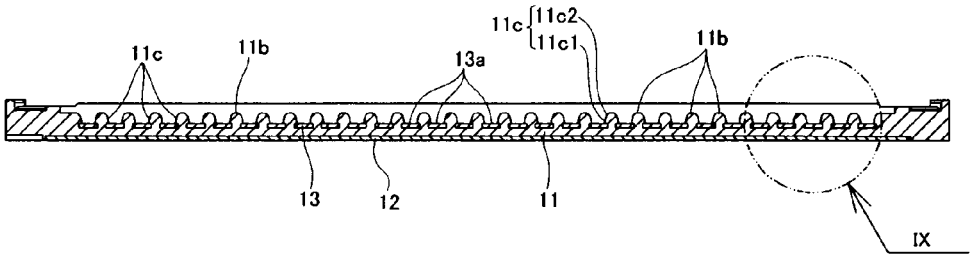
FIG. 8 is a longitudinal sectional view for description along a line indicated by a reference character VIII-VIII in FIG. 5.

Still further, as depicted particularly in FIG. 7, in the conductive contact 13 in the present embodiment, a terminal edge part 13*b* on a rear end side of the conductive contact 13 in an extending direction (the vertical direction in FIG. 7) is disposed within a range in a fore-and-aft direction in which the contact engaging parts 11*b* extend as described above. More specifically, the terminal edge part (a lower end part in FIG. 7) 13*b* of the conductive contact 13 is disposed at a position drawn from the rear end part (a lower end part in FIG. 7) 11*d* of the contact engaging part 11*b* to a slightly forward side (an upper side in FIG. 7).

With this structure, the contact engaging parts 11*b* are arranged so as to be adjacent to each other over the overall length of the rear end portion including the terminal edge part 13*b* of the conductive conductor 13, that is, the part where the center conductor SC1 of the fine-line cable (the cable-shaped signal transmission medium) SC. Therefore, a contact between the terminal edge part of the conductive contact 13 and another member can be avoided, and electrical insulation can be excellently achieved.

Still further, at the terminal portion at the rear end portion of the conductive contact 13 in the present embodiment, as depicted particularly in FIG. 7, a dimension of the conductive contact 13 in a width direction, that is, a dimension in a contact width direction (the connector longitudinal direction) orthogonal to an extending direction, is narrowed, and a width-direction dimension of the terminal edge part 13*b* at the narrowed rear end portion is set as a terminal width (t1). The narrowed terminal width (t1) in the conductive contact 13 is formed so as to be shorter than the minimum width (W1) between the paired adjacent contact engaging parts 11*b* on the cable mounting surface 13*a* where the center conductor SC1 of the fine-line cable (the cable-shaped signal transmission medium) SC described above is mounted (t1>W1). The terminal part at the rear end portion of the conductive contact 13 having the terminal width (t1) with the width dimension thus narrowed extends to the terminal edge part 13*b* as deviating inwardly from the guide inclined surface 11*c* of the contact engaging part 11*b* described above.

Figure 13:
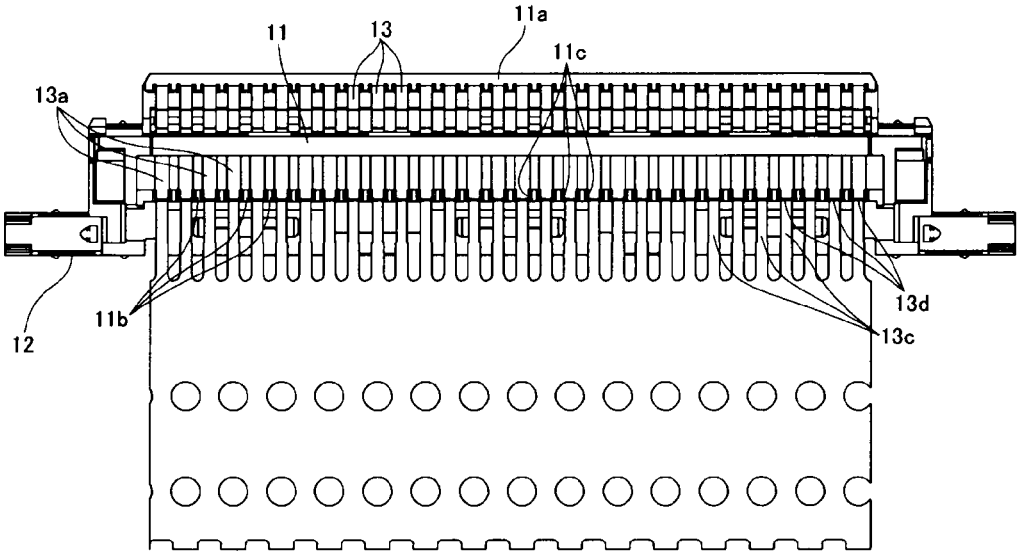
FIG. 13 depicts a conductive contact manufacturing process, depicting a plan view for describing a state in which a plurality of conductive contacts are coupled via a carrier.
Figure 14:
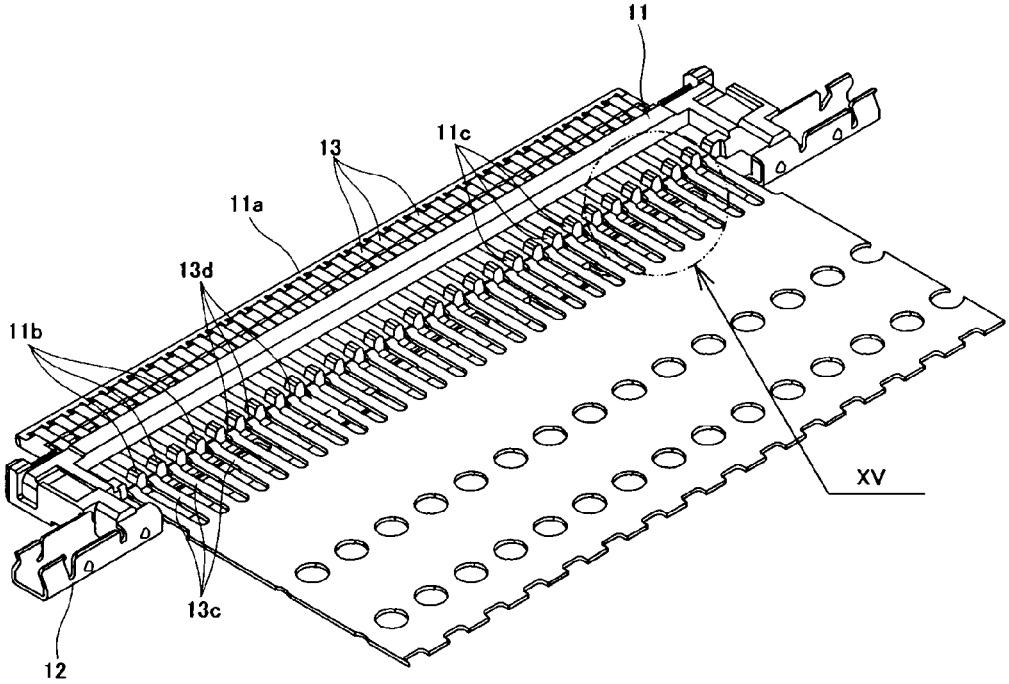
FIG. 14 is an external perspective view of the plug connector depicted in FIG. 13.
Figure 15:
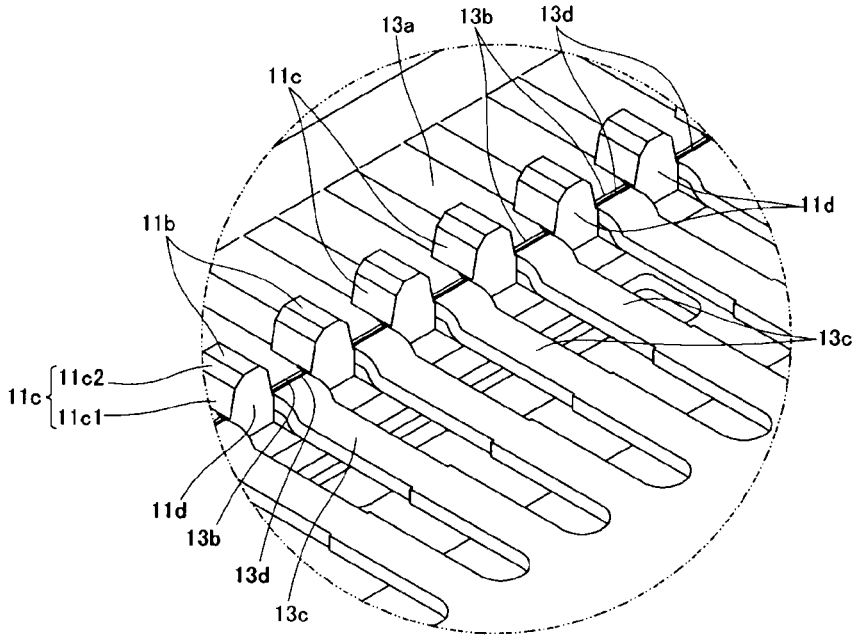
FIG. 15 is an external perspective view for describing a portion indicated by a reference character XV in FIG. 14 being enlarged.

As such, with the terminal portion at the rear end portion of the conductive contact 13 having a narrowed structure, the terminal edge part 13*b* at the rear end portion of the conductive contact 13 can be easily cut out, thereby improving productivity. That is, when the plurality of conductive contacts 13 are mounted at the same time, as exemplarily depicted in FIG. 13 to FIG. 15, it is effective to integrally manufacture all of the plurality of conductive contacts 13, setting one conductive contact 13 in a state of coupling to another conductive contact 13 via a carrier 13*c*, and then collectively mounting all of the plurality of conductive contacts 13. In this case, as described above, with the terminal portion of the conductive contact 13 on the rear end side being narrowed, all of the conductive contacts 13 are simultaneously mounted, and then cutting-out at the terminal edge part 13*b* of the conductive contact 13 on the rear end side can be easily made by folding or the like.

In particular, in the present embodiment, a groove-shaped notch 13*d* extending in a plate width direction is formed at the terminal portion at the rear end portion of the conductive contact 13 narrowed as described above. Therefore, cutting out the conductive contact 13 at the terminal edge part 13*b* can be easily made along the notch 13*d*, thereby allowing the plurality of conductive contact 13 to be collectively manufactured and mounted and improving productivity.

Second Embodiment

Figure 16:
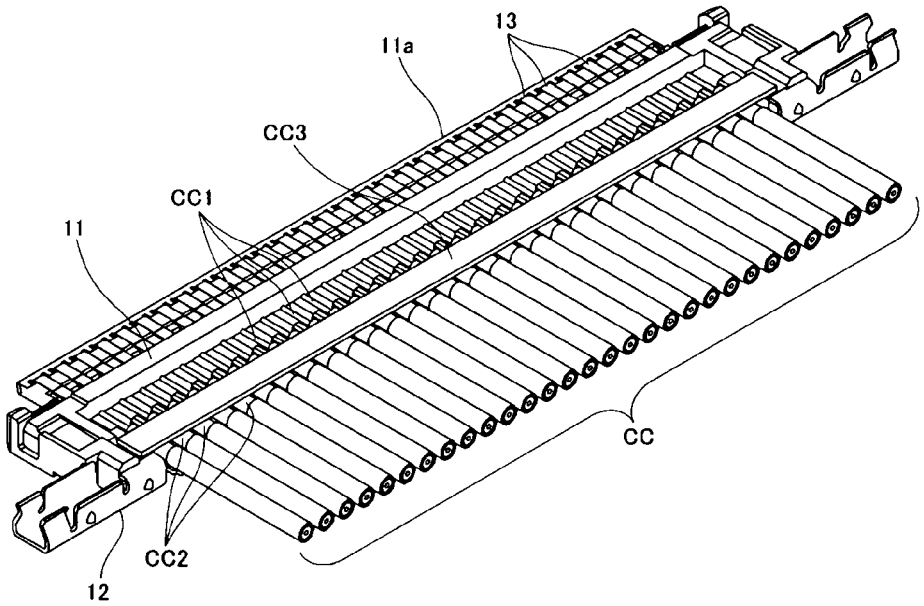
FIG. 16 is an external perspective view for describing a state in which a terminal part of a cable-shaped signal transmission medium (coaxial cables) is coupled to a plug connector according to a second embodiment of the present invention via ground bars and a conductive shell on an upper side is removed.
Figure 17:
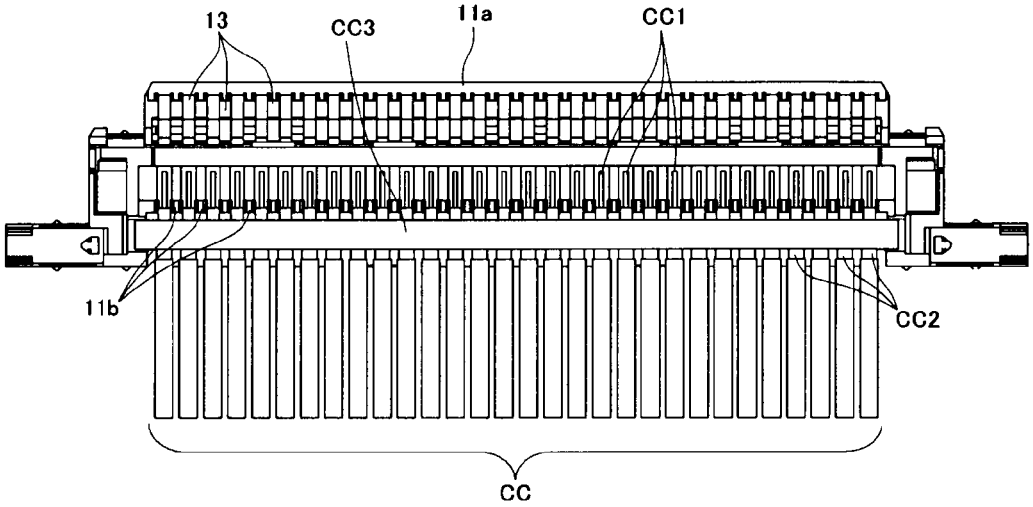
FIG. 17 is a plan view for describing the plug connector depicted in FIG. 16.
Figure 18:
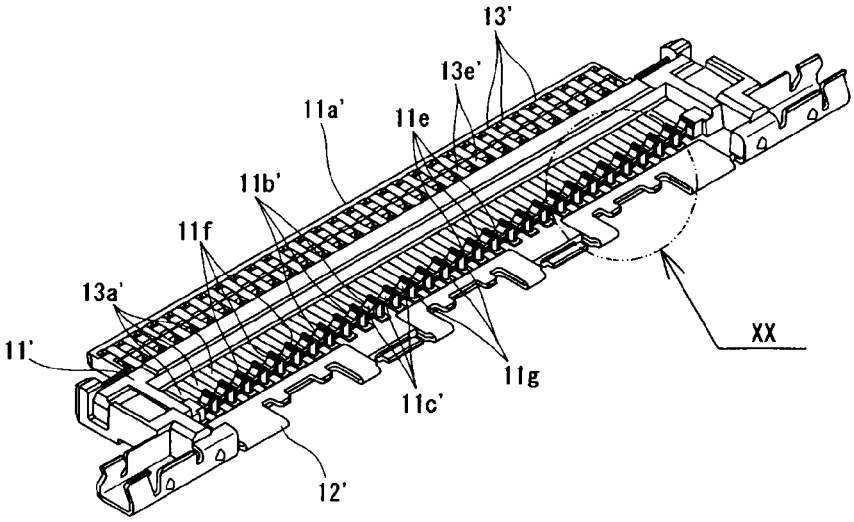
FIG. 18 is an external perspective view depicting a plug connector according to a third embodiment of the present invention in which a conductive shell is removed and a cable-shaped signal transmission medium (cables) is further removed.
Figure 19:
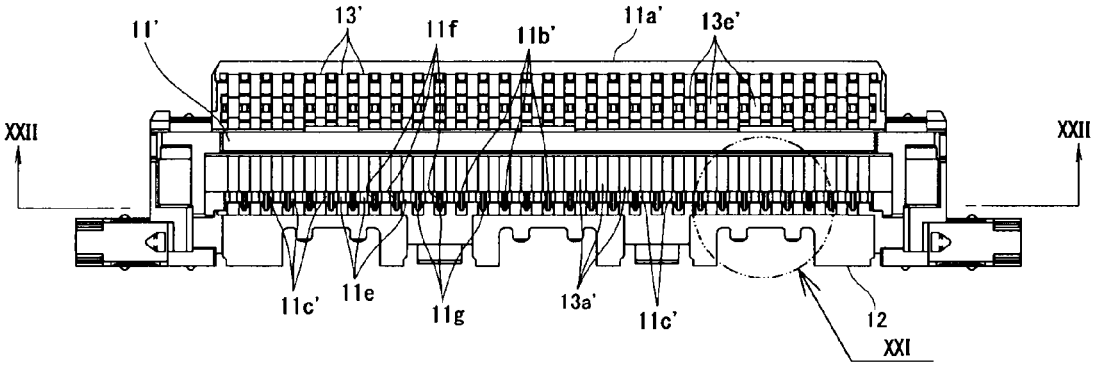
FIG. 19 is a plan view for describing the plug connector depicted in FIG. 18.
Figure 20:
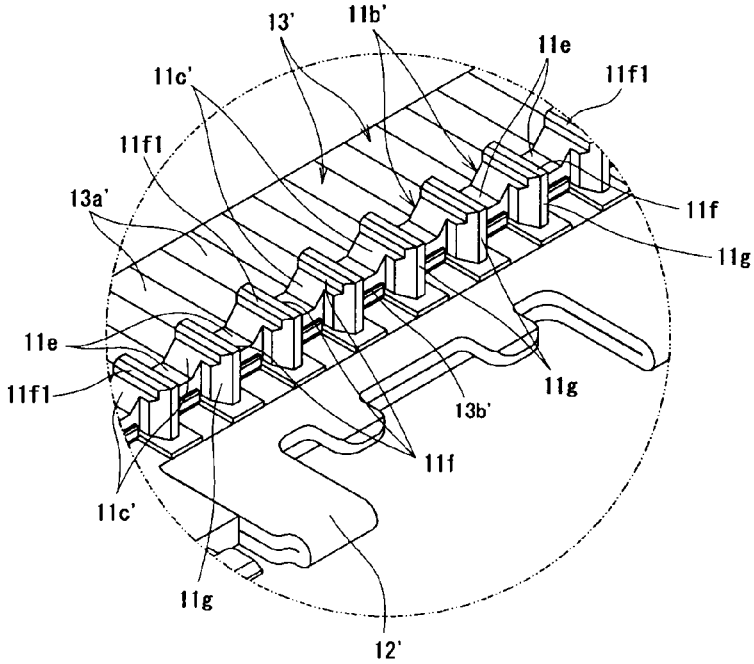
FIG. 20 is an external perspective view for describing a portion indicated by a reference character XX in FIG. 18 being enlarged.

On the other hand, in a second embodiment regarding FIG. 16 and FIG. 17, where components identical to those of the first embodiment described above are provided with the same reference characters, a fine-line coaxial cable CC is used as a cable-shaped signal medium. That is, each of the fine-line coaxial cables CC coupled in a multipolar shape is configured so that an outer perimeter side of a center conductor CC1 for signal transmission is concentrically surrounded by an external conductor CC2 for grounding, a terminal part of the fine-line coaxial cable CC is stripped to be exposed, and the center conductor CC1 protrudes from the external conductor CC2 frontward. Of the cable, the center conductor CC1 is mounted from above on a rear end side portion (a lower end side portion in FIG. 17) of the conductive contact 13 described above, and solder jointing is performed with this contact arrangement state. Here, solder jointing is collectively performed on all of those in a multipolar arrangement direction.

Also, paired ground bars CC3 are disposed on contact so as to interpose the external conductor CC2 of the fine-line coaxial cable (a signal transmission medium) CC described above from both of upper and lower sides. Each of these ground bars CC3 is formed of a metal member in a thin-plate shape extending in the connector longitudinal direction, and is collectively solder-jointed to all of the external conductors CC2 arranged in a multipolar shape. An arrangement relation is established in which a part of a conductor shell 12 makes contact with each of these ground bars CC3. For example, a contact spring part formed so as to be in a cantilever tongue shape on an upper surface part of the conductive shell 12 elastically makes contact with a surface of the ground bars CC3. Also in the second embodiment as described above, similar operation and effect can be obtained.

In particular, in the second embodiment, with the use of the ground bars CC3, there is a possibility that the ground bars CC3 and the conductive contact 13 may make contact with each other to cause a short circuit. However, an arrangement is made in which a contact engaging part 11*b* is adjacent over an entire terminal edge part 13*b* of the conductive contact 13 on a rear end side, thereby making it possible to reliably preventing the situation as described above.

Third Embodiment

Next, a plug connector 10' according to a third embodiment depicted in FIG. 18 to FIG. 25 is described. Components corresponding to those in the first embodiment described above are provided with the same reference characters with a symbol "'" and basic detailed description thereof is omitted, and different structures are mainly described herein.

Figure 30:
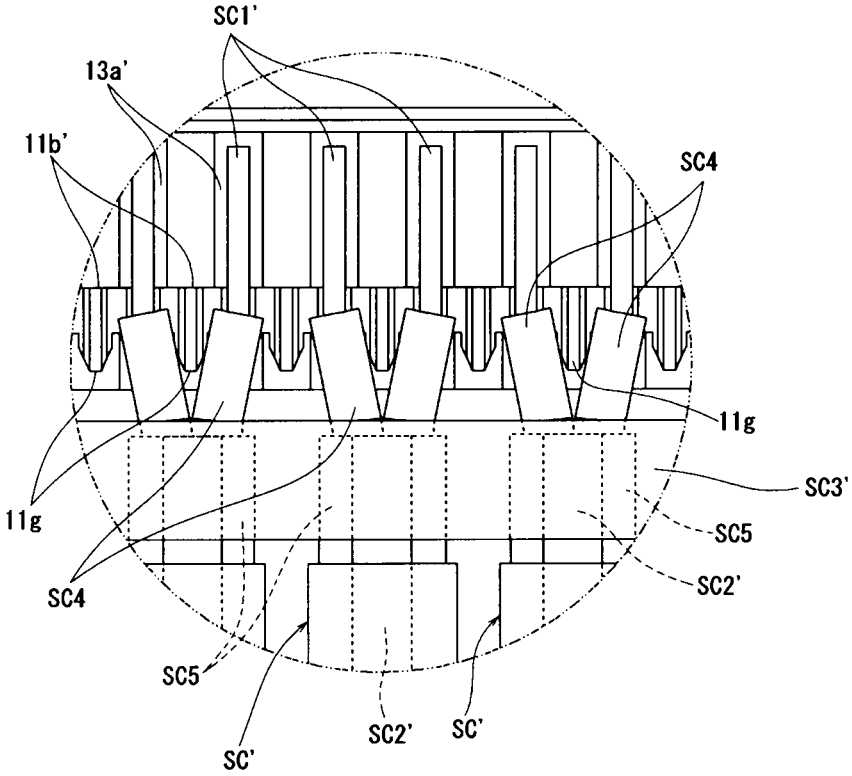
FIG. 30 is a plan view of a plug connector for describing a portion indicated by a reference character XXX in FIG. 29 being enlarged.

First, a cable-shaped signal transmission medium for use in the present embodiment is configured of a twin coaxial cable with a set of two fine-line coaxial cables SC' as one cable. A center conductor SC1' of each of the fine-line coaxial cables SC' is covered with a center-side insulator SC4, and a plate-shaped external conductor SC2' is mounted on an outer-perimeter-side insulator SC5 disposed so as to surround a set of two center-side insulators SC4. Also, for example, as depicted in FIG. 30, the center conductors SC1' of the fine-line coaxial cables SC' are arranged with an arrangement pitch of the center conductors SC1' of the fine-line coaxial cables SC' being narrowed more than the other embodiments described above. Furthermore, correspondingly to the narrowed pitch space of the center conductors SC1' of each of the fine-line coaxial cables SC', conductive contacts 13' according to the present embodiment are arranged in a multipolar shape in the connector longitudinal direction.

Similarly to the embodiments described above, each of these conductive contacts 13' has a cable mounting surface 13*a*' where the center conductor SC1' with the center-side insulator SC4 of the fine-line coaxial cable (the cable-shaped signal transmission medium) SC' stripped, and the cable mounting surface 13*a*' is buried so as to be exposed to an upper surface of an insulating housing 11'. On the other hand, in the present embodiment, a rear end supporting part 13*f* extends rearward from the cable mounting surface 13*a*'. This rear end supporting part 13*f* is configured to extend rearward in a state of falling by one stage with a step from the cable mounting surface 13*a* described above and be buried inside the insulating housing 11' so as to crawl from the cable mounting surface 13*a*' to the inside of the insulating housing 11'.

The rear end supporting part 13*f* forming a part of the conductor contact 13' is covered from above with a part of the insulating housing 11'. The part of the insulating housing 11' covering the rear end supporting part 13*f* includes a contact engaging part 11*b*' for holding the conductor contact 13' and a part coupling adjacent paired contact engaging parts 11*b*' together. That is, while the contact engaging part 11*b*' is provided integrally with the insulating housing 11' also in the present embodiment, a shape with an approximately mountainous-shaped sectional shape continuing in a fore-and-aft direction (a vertical direction in FIG. 21) is adopted for the contact engaging part 11*b*' in the present embodiment, and a lower-end corresponding part of a guide inclined surface 11*c*' forming the approximately mountainous-shaped inclined surface part is disposed so as to cover, from above, a part of the surface of the rear end supporting part 13*f* of the conductive contact 13' describe above, more specifically, both end edge parts in a width direction on the surface of the rear end supporting part 13*f*. Also, the lower-end corresponding parts of the paired adjacent contact engaging parts 11*b*' are integrally coupled together by a part of the insulating housing 11', and the integrally coupled part is disposed so as to cover, from above, a center part in the width direction on the surface of the rear end supporting part 13*f* described above.

The structure in which a part of the conductive contact 13' is buried inside of the insulating housing 11' as described above is made with an arrangement relation in which the arrangement pitch of the fine-line coaxial cables (the cable-shaped signal transmission medium) SC' and the conductive contacts 13' is narrowed and, correspondingly, adjacent contact engaging parts 11*b*' are close to each other. That is, in the present embodiment, correspondingly to the narrowed pitch structure described above, the adjacent contact engaging parts 11*b*' are close to each other and, accordingly, the guide inclined surfaces 11*c*' are integrally coupled with a part of the insulating housing. An upper surface of a coupling part of the insulating housing 11', that is, an integrally coupling part of the guide inclined surfaces 11*c*', serves as a cable mounting surface 11*e*.

On the surface of the cable mounting surface 11*e* provided on an insulating housing 11' side, a center-side insulator SC4 covering the enter conductor SC1' of the fine-line coaxial cable (the cable-shaped signal transmission medium) SC' is mounted. On the surface of the cable mounting surface 13*a*' on a conductive contact 13' side described above, the center conductor SC1' of the fine-line coaxial cable SC'. These cable mounting surfaces 11*e* and 13*a*' are formed so as to continue in a flat surface shape without a step. With the structure having this flat surface shape, the fine-line coaxial cable SC' can be stably mounted.

According to this structure of the present embodiment, the conductive contact 13' can be more prevented from being peeled off. That is, in the present embodiment, as the adjacent fine-line coaxial cables (the cable-shaped signal transmission medium) SC' are arranged with a narrower pitch, a space for disposing the conductive contacts 13' is narrowed, and therefore a fixing means (refer to FIG. 12) protruding outwardly from an end edge part of the conductive contact 13' in a width direction is not provided. Thus, a holding strength of the conductive contact 13' may be decreased. However, in the present embodiment, since the rear end supporting part 13*f* of the conductive contact 13' is disposed so as to be buried in the insulating housing 11', the rear end supporting part 13*f* of the conductive contact 13' and the conductive contact 13' as a whole are held with a sufficient strength, thereby more preventing peeling-off from the insulating housing 11'.

Figure 26:
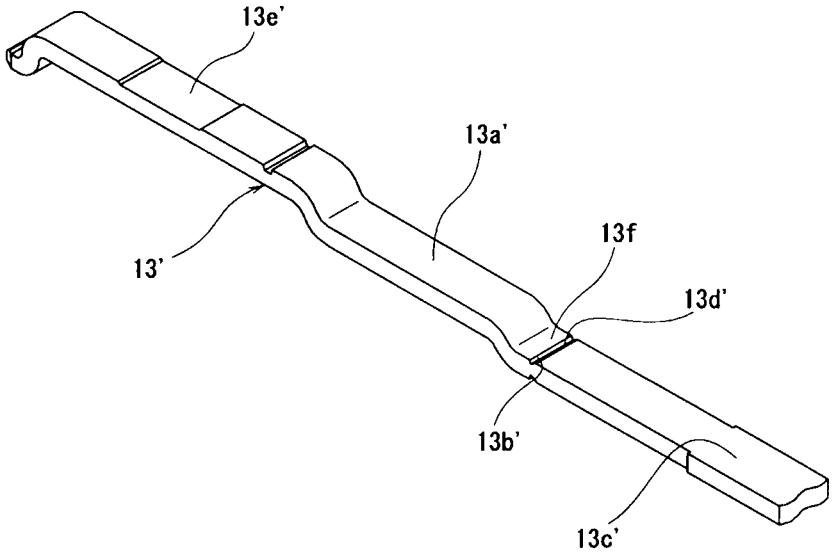
FIG. 26 depicts a single conductive contact for use in the plug connector depicted in FIG. 18 to FIG. 25, depicting an external perspective view for describing a state before a coupling carrier is cut out.
Figure 27:
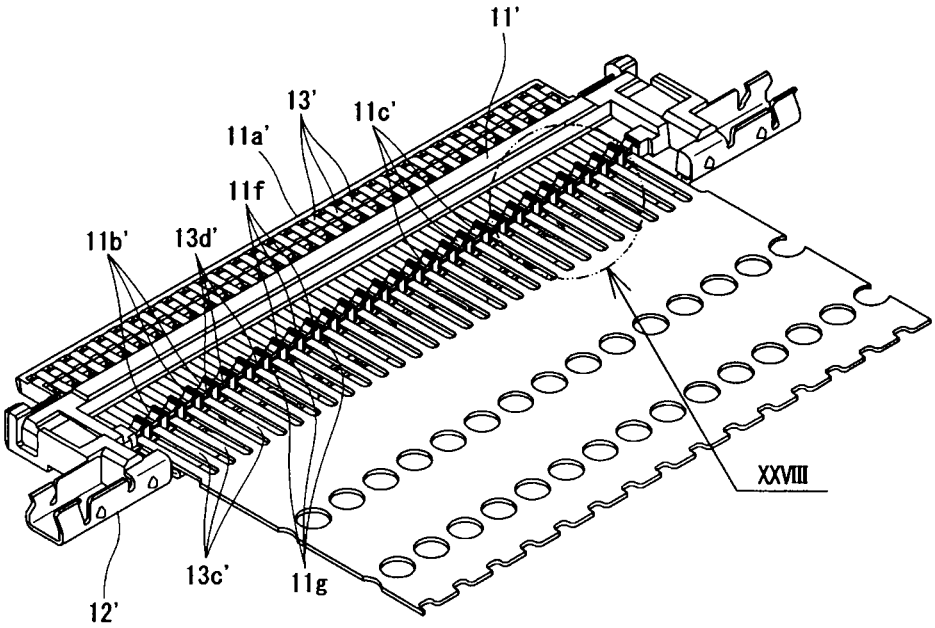
FIG. 27 depicts a conductive contact manufacturing process, depicting an external perspective view for describing a state in which a plurality of conductive contacts coupled via a carrier are mounted.

Note that, as with the embodiments described above, on a front edge side portion (an upper end side portion in FIG. 19) of the conductive contacts 13', fit-in contact parts 13*e*' (refer to FIG. 26) elastically making contact with conductive contacts on a receptacle connector side are disposed so as to form a multipolar electrode shape. Also, to the rear end supporting part 13*f* of the conductive contact 13', a carrier 13*c*' collectively coupling all of the plurality of conductive contacts 13' via a notch 13*d*' for cutting-out provided at a terminal edge part of the rear end supporting part 13*f* is continuously provided.

Here, the guide inclined surface 11*c*' of the contact engaging part 11*b*' in the present embodiment is raised upwardly from the cable mounting surface 11*e* at a relatively mild angle, and a distance between adjacent paired guide inclined surfaces 11*c*' continuously increases in a rising direction. Here, as depicted particularly in FIG. 25, a distance (W) between the adjacent paired guide inclined surfaces has a minimum width (W4) narrowest at a position along the surface of the cable mounting surface 11*e*. Also, the minimum width (W4) between the contact engaging parts 11*b*' is set shorter than an outer diameter dimension (d') of the center-side insulator SC4 of the fine-line coaxial cable (the cable-shaped signal transmission medium) SC' described above (W4<d').

Furthermore, the distance (W) between the paired guide inclined surfaces has a maximum width (W5) at a position of a maximum height (h1) rising from the cable mounting surface 11*e* described above. Also, the maximum distance (W5) between the guide inclined surfaces 11*c*' is set longer than the outer diameter dimension (d') of the center-side insulator SC4 of the fine-line coaxial cable (the cable-shaped signal transmission medium) SC' (W5>d').

With this structure being adopted, the center-side insulator SC4 of the fine-line coaxial cable (the cable-shaped signal transmission medium) SC' is easily received through a portion where paired contact engaging parts 11*b*' form the maximum width (W5), and the center-side insulator SC4 is then inserted onto the cable mounting surface 11*e* as being smoothly guided along the surfaces of both of the guide inclined surfaces 11*c*'. Thus, the operation of mounting the fine-line coaxial cable SC' can be stably performed by using the contact engaging parts 11*b*'. Therefore, operations at the time of mounting the fine-line coaxial cables SC', such as positioning, can be easily and accurately performed, bringing efficiency to the mounting operation.

Furthermore, as described above, the minimum width (W4) between adjacent paired contact engaging parts 11*b*' along the surface of the cable mounting surface 13*e* is set shorter than the outer diameter dimension (d') of the external conductor SC2' of the fine-line coaxial cable (the cable-shaped signal transmission medium) SC' (W4<d'). Therefore, the fine-line coaxial cable SC' can be more accurately positioned. Even when the conductor contacts 13' are arranged with narrow pitches, similar operation and effect can be achieved, thereby improving productivity.

On the other hand, as described above, when the distance (W) between adjacent paired guide inclined surfaces 11*c*' is minimum on the cable mounting surface 11*e* and is set shorter than the center-side insulator SC4 of the fine-line coaxial cable (the cable-shaped signal transmission medium) SC' (W4<d'), the distance (W) between the guide inclined surfaces 11*c*' at the height position corresponding to a diameter (r') of the center-side insulator SC4 of the fine-line coaxial cable SC' is formed so as to be approximately equal to the maximum width (W5) described above.

Furthermore, in the present embodiment, the minimum width (W4) between adjacent paired guide inclined surfaces 11*c*' described above is set to be shorter than a width dimension (W7) of the conductive contact 13' (W4<W7). With this, the guide inclined surface 11*c*' of the contact engaging part 11*b*' is reliably disposed at an upper position of the conductive contact 13', thereby excellently holding the conductive contact 13'.

Still further, even when an external force due to so-called flapping or the like is added from the fine-line coaxial cable SC' to the conductive contact 13' via the fine-line coaxial cable (the cable-shaped signal transmission medium) SC', the rear end side portion of the conductive contact 13' to which the fine-line coaxial cable SC' is coupled is directly held by the contact engaging part 11*b*' provided to the insulating housing 11' and the rear-end supporting part 13*f* buried inside the insulating housing 11'. Therefore, the conductive contact 13' can be prevented well from being peeled off.

Figure 23:
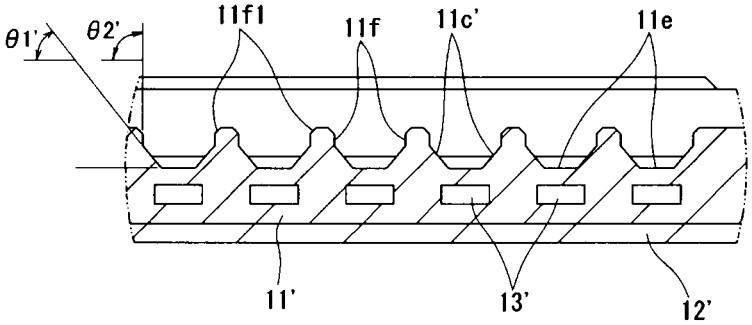
FIG. 23 is a longitudinal sectional view for describing a portion indicated by a reference character XXIII in FIG. 22 being enlarged.
Figure 24:
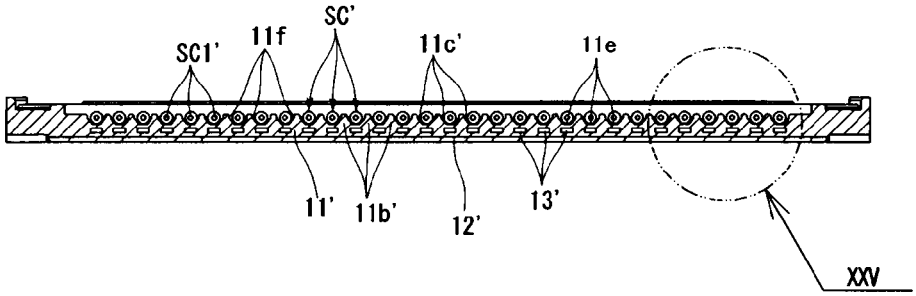
FIG. 24 is a longitudinal sectional view for describing a state changed from the state depicted in FIG. 22 after fine-line cables (a cable-shaped signal transmission medium) are mounted.
Figure 25:
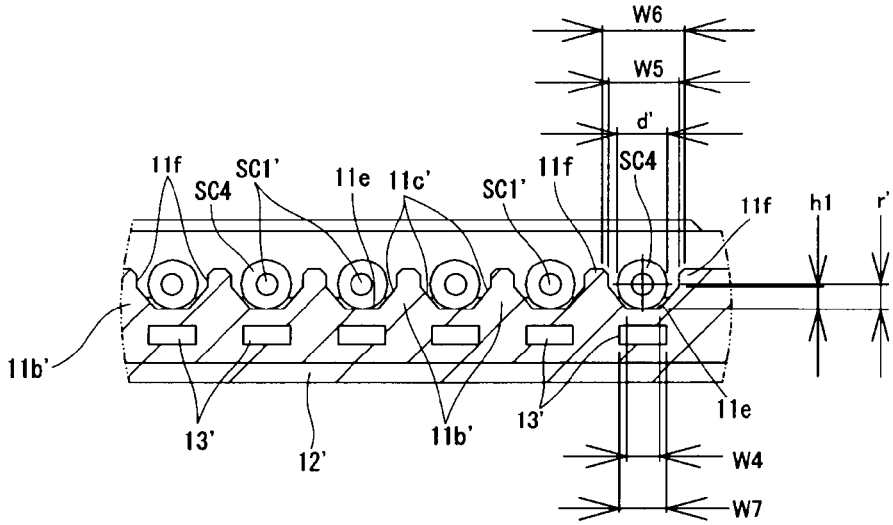
FIG. 25 is a longitudinal sectional view for describing a portion indicated by a reference character XXV in FIG. 24 being enlarged.

Furthermore, as depicted particularly in FIG. 23 and FIG. 25, from an upper end part of the guide inclined surface 11*c*' of the contact engaging part 11*b*' according to the present embodiment, an introduction guide surface 11*f* forming a vertical wall shape is continuously provided so as to rise upwardly. That is, as described above, the guide inclined surface 11*c*' is raised so as to form a relatively mild first tilt angle (θ1') from the cable mounting surface 11*e*, and the introduction guide surface 11*f* protruding upwardly so as to form a second tilt angle (θ2'=90 degrees) forming a right angle with respect to the cable mounting surface 11*e* is provided from an upper end part of the guide inclined surface 11*c*'.

Here, at the upper end portion of the introduction guide surface 11*f*, an initial abutting surface 11*f*1 inclined at an angle of approximately 45 degrees is formed. A distance between initial abutting surfaces 11*f*1 provided on adjacent introduction guide surfaces 11*f* is set a distance (W6) that is slightly longer than the maximum width (W5) between the guide inclined surfaces 11*c*' described above (W6>W7).

With this structure being adopted, at an initial stage of mounting the fine-line coaxial cable (the cable-shaped signal transmission medium) SC', the fine-line coaxial cable SC' is disposed so as to be easily positioned between the initial abutting surfaces 11*f*1 of the adjacent introduction guide surfaces 11*f*, thereby smoothly performing an operation of mounting the fine-line coaxial cable SC'.

Furthermore, as depicted particularly in FIG. 25, in the guide inclined surface 11*c*' provided to the contact engaging part 11*b*', the maximum height (h1) from the cable mounting surface 11*e* where the center-side insulator SC4 of the fine-line coaxial cable (the cable-shaped signal transmission medium) SC' is set shorter than the radius (r') of the center-side insulator SC4 of the fine-line coaxial cable SC' (h1<r'). In the guide inclined surface 11*c*' in this case, the holding power for holding the fine-line coaxial SC' is decreased compared with that in the embodiments described above. However, in the present embodiment, as described above, the introduction guide surface 11*f* protruding upwardly at an approximately right angle with respect to the cable mounting surface 11*e* is provided, thereby stably holding the fine-line coaxial SC'.

Figure 28:
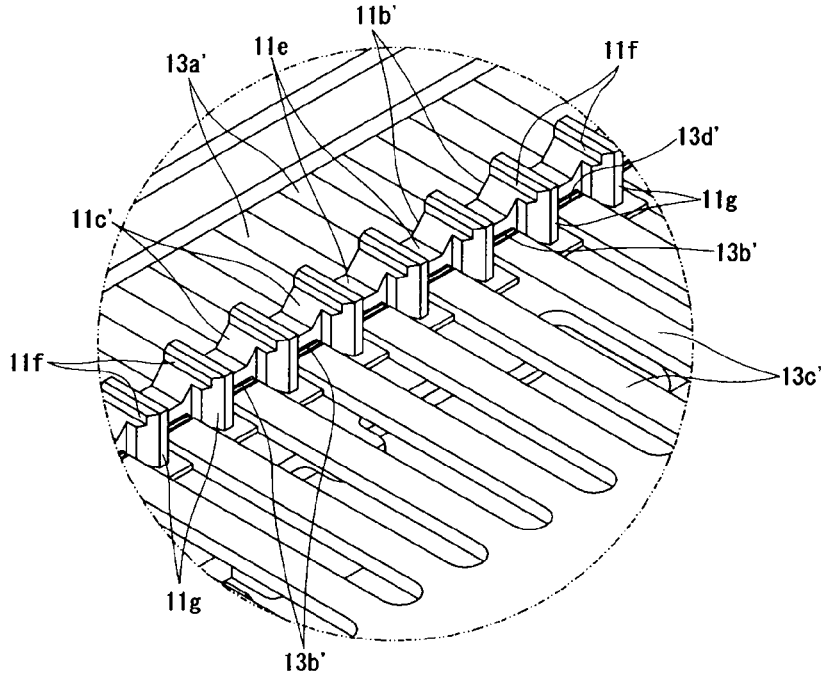
FIG. 28 is an external perspective view for describing a portion indicated by a reference character XXVIII in FIG. 27 being enlarged.

Still further, the contact engaging part 11*b*' described above is provided with a separation guide piece 11*g* as depicted in FIG. 28 and FIG. 30 protruding toward a rear side (a rear side in FIG. 30). This separation guide piece 11*g* is formed so as to form an approximately cuneal shape in a planar view, and has a function of separating both of the fine-line coaxial cables SC' horizontally in the drawing, with a rear end portion at an acute angle in the separation guide piece 11*g* being inserted between both of the center-side insulators SC4 of the paired fine-line coaxial cables (the cable-shaped signal transmission medium) SC' forming the twin coaxial cable described above.

With this structure being adopted, when the fine-line coaxial cable SC' formed of a twin coaxial cable is mounted, both of the center-side insulators SC4 are positionally regulated by the separation guide piece 11*g* so as to extend in a scheduled direction. Therefore, the twin coaxial cable can be efficiently and accurately mounted, and cable breakage can be prevented.

Figure 21:
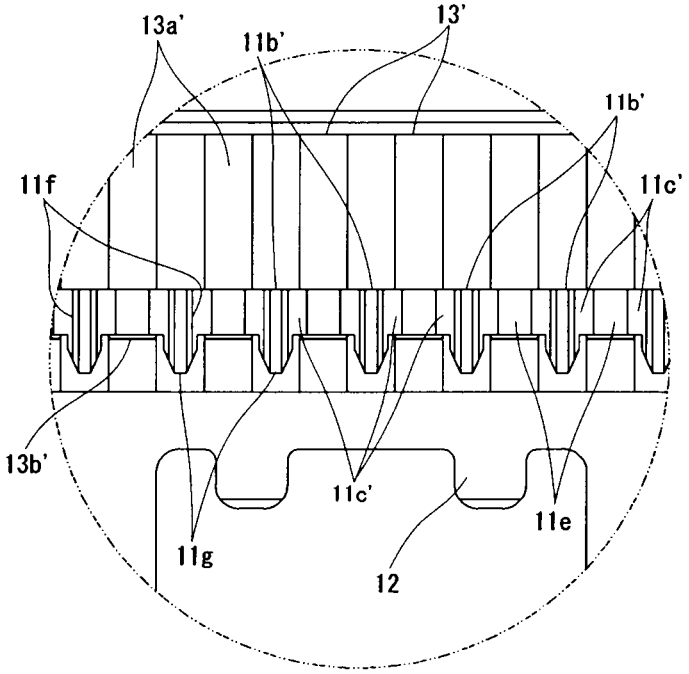
FIG. 21 is a plan view for describing a portion indicated by a reference character XXI in FIG. 19 being enlarged.
Figure 22:
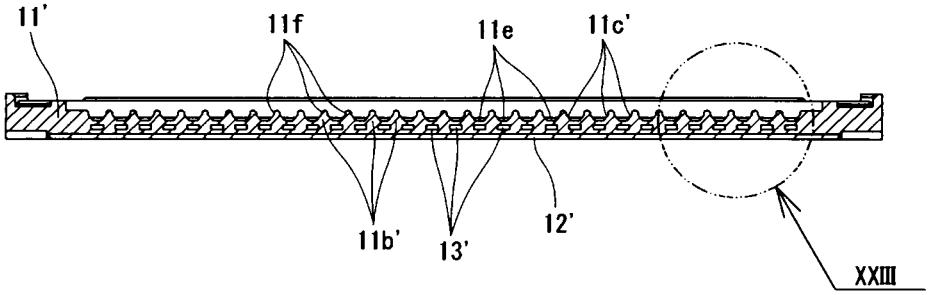
FIG. 22 is a longitudinal sectional view for description along a line indicated by a reference character XXII-XXII in FIG. 19.

Also, with respect to the separation guide piece 11*g*, as depicted particularly in FIG. 21, a terminal edge par 13*b*' of a rear-end supporting part 13*f* forming a rear end side portion of the conductive contact 13 described above is disposed between a rear end part of the separation guide piece 11*g* (a lower end part in FIG. 21) and a front end part of the contact engaging part 11*b*' (an upper end part in FIG. 21). In the present embodiment, the terminal edge part 13*b*' is disposed at a position drawn slightly to a front side (an upper side in FIG. 21) from the rear end part of the separation guide piece 11*g* (the lower end part in FIG. 21). With this arrangement relation, a contact between the terminal edge part 13*b*' of the conductive contact 13' and another member, for example, the ground bar SC3' (refer to FIG. 29 and FIG. 30) is prevented, and electrical insulation is well achieved.

Figure 29:
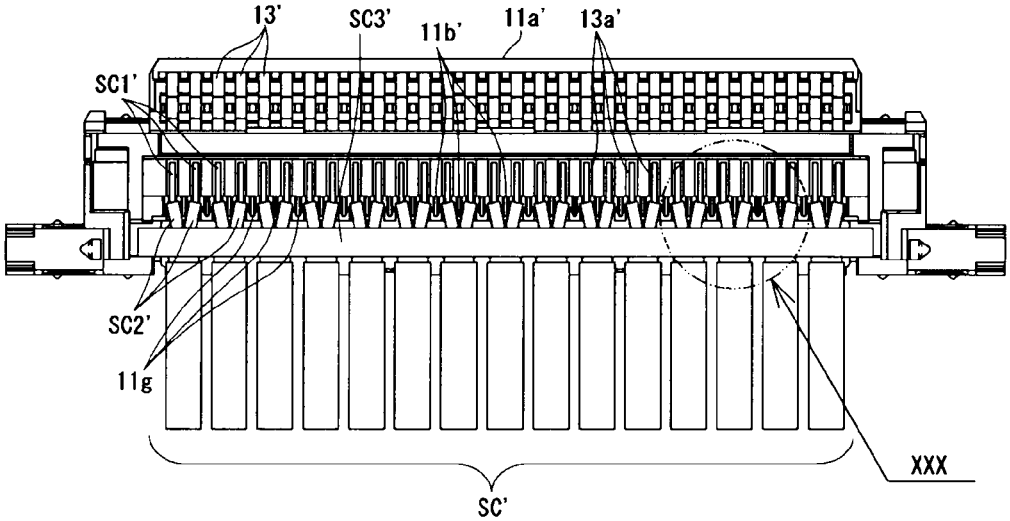
FIG. 29 is an external perspective view depicting a state in which a terminal part of fine-line cables formed of twin coaxial cables is coupled with a ground bar to a plug connector according to a third embodiment of the present invention and a conductive shell on an upper side is removed.

That is, as depicted in FIG. 29 and FIG. 30, paired ground bars SC3' are disposed on contact so as to interpose the external conductor SC2' of the fine-line coaxial cable (the cable-shaped signal transmission medium) SC' described above from both of upper and lower sides. Each of these ground bars SC3' is formed of a metal member in a thin-plate shape extending in the connector longitudinal direction, and is collectively solder-jointed to all of the external conductors SC2' arranged in a multipolar shape. An arrangement relation is established in which a part of a conductor shell 12 makes contact with each of these ground bars SC3'. For example, a contact spring part formed so as to be in a cantilever tongue shape on an upper surface part of the conductive shell 12 elastically makes contact with a surface of the ground bars SC3'.

With the use of the ground bars SC3', there is a possibility that the ground bars SC3' and the conductive contact 13' may make contact with each other to cause a short circuit. However, as described above, an arrangement is made in which the contact engaging part 11*b*' is adjacent over an entire terminal edge part 13*b*' of the conductive contact 13' on a rear end side, thereby making it possible to reliably preventing the situation as described above.

In the present embodiment, a notch part is formed at a rear end portion of the conductive shell 12' as a connector cover covering an outer surface of the insulating housing 11' to interrupt electromagnetic wave noise from outside and others.

While the invention devised by the inventor has been specifically described based on the embodiments, it goes without saying that the embodiments are not restricted to those described above and can be variously modified without deviating from the gist of the invention.

For example, in the embodiments described above, the conductive contacts disposed in a multipolar shape are formed so as to have an approximately same shape. Alternatively, the conductive contacts can have different shapes.

Furthermore, in the embodiments described above, the present invention is applied to an electric connector of a horizontal fit-in type. Alternatively, the present invention can be similarly applied to an electric connector of a vertical fit-in type.

Still further, the present invention is not meant to be restricted to a cable-shaped signal transmission medium disposed in a multipolar shape as in the embodiments described above, and can be similarly applied to a single fine-line coaxial cable connector, an electric connector of a type in combination of a plurality of fine-line coaxial cables and insulating cables, an electric connector to which a flexible wiring substrate or the like is coupled, and others.

Still further, in the embodiments described above, the guide inclined surface 11*c* of the contact engaging part 11*b* is configured as a guide member for a center conductor of a cable. Alternatively, the guide inclined surface 11*c* may be configured as a guide for an outer perimeter surface of a cable.

Still further, in the embodiments described above, the guide inclined surface is configured as flatly extend. Alternatively, the guide inclined surface can extend so as to form a concave curved surface. That is, a flat guide inclined surface allows a quick operation of guiding a cable-shaped signal transmission medium, and a concave curved guide inclined surface increases a contact area with a cable-shaped signal transmission medium to allow stable support.

Still further, in each of the embodiments described above, the guide inclined surface provided on the contact engaging part is formed so as to cover a part of the surface of the conductive contact in a width direction. Alternatively, the guide inclined surface can be configured so as to cover an entire surface of the conductive contact in a width direction.

As described in the foregoing, the embodiments can be widely applied to various types of electric connectors for use in various electric devices.

What is claimed is:

1. An electric connector comprising:

an insulating housing; and a conductive contact buried in the insulating housing so as to be exposed to a surface of the insulating housing, the conductive contact extending from a rear end portion to be coupled with a terminal part of a cable-shaped signal transmission medium to a front end portion toward a fitting-in counterpart connector side;

wherein the insulating housing is provided with a contact engaging part covering at least a part of a rear end portion on a surface of the conductive contact exposed to the surface of the insulating housing, the contact engaging part includes a guide inclined surface facing the cable-shaped signal transmission medium from both sides in a contact width direction perpendicular to an extending direction of the conductive contact to position the cable-shaped signal transmission medium, and the guide inclined surface is disposed on each of both sides of the cable-shaped signal transmission medium in a pair, and the paired guide inclined surfaces are formed so as to be separated from each other in a direction of rising from a cable mounting surface where the cable-shaped signal transmission medium is mounted, wherein the contact engaging part includes a first end surface and a second end surface, and a length of the contact engaging part extends from the first end surface to the second end surface in the extending direction, wherein the conductive contact has a terminal edge part provided at a rear end portion of the conductive contact in the extending direction, the terminal edge part being disposed along the length of the contact engaging part between the first end and the second end, and the terminal edge part of the conductive contact is disposed at a position drawn from the rear end part of the contact engaging part to a slightly forward side.

2. The electric connector according to claim 1, wherein the guide inclined surface has a maximum height from the cable mounting surface where the cable-shaped signal transmission medium is mounted set larger than a diameter of the cable-shaped signal transmission medium.

3. The electric connector according to claim 2, wherein the guide inclined surfaces are disposed so as to face each other with a predetermined distance in the contact width direction, and a distance between the guide inclined surfaces facing each other is set longer than an outer diameter of the cable-shaped signal transmission medium at a position of the maximum height of the guide inclined surface from the cable mounting surface.

4. The electric connector according to claim 1, wherein the guide inclined surface has a first inclined surface rising so as to form a first tilt angle with respect to the cable mounting surface and a second inclined surface extending to form a second tilt angle with respect to the cable mounting surface from a rising end of the first inclined surface, and the second tilt angle is set smaller than the first tilt angle.

5. The electric connector according to claim 4, wherein a height from the cable mounting surface to the rising end of the first inclined surface is set longer than a diameter of the cable-shaped signal transmission medium.

6. The electric connector according to claim 1, wherein the conductive contact has a dimension in the contact width direction perpendicular to the extending direction, the dimension narrowed at a terminal edge part provided at a rear end portion of the conductive contact in the extending direction, and a terminal width of the narrowed conductive contact is formed so as to be shorter than a minimum width between the contact engaging parts on the cable mounting surface where the cable-shaped signal transmission medium is mounted.

7. The electric connector according to claim 1, wherein a distance between the adjacent guide inclined surfaces has a minimum width along the cable mounting surface where the cable-shaped signal transmission medium is mounted, and the minimum width is set shorter than an outer diameter of the cable-shaped signal transmission medium.

8. The electric connector according to claim 1, wherein the guide inclined surface is formed so as to entirely or partially cover the conductive contact, and the cable-mounting surface is formed of a part of the conductive contact or the insulating housing between the paired guide inclined surfaces disposed on both sides of the cable-shaped signal transmission medium.

9. The electric connector according to claim 8, wherein the guide inclined surface is formed so as to partially cover a surface of the conductive contact in a width direction, each of the paired guide inclined surfaces is formed so as to cover a side end edge portion of the conductive contact interposed between the guide inclined surfaces, and the paired guide inclined surfaces are integrally coupled by a part of the insulating housing, and the cable mounting surface is formed of a part of the insulating housing integrally coupling the guide inclined surfaces.

10. The electric connector according to claim 8, wherein with the guide inclined surface being formed so as to entirely cover the surface of the conductive contact, the cable mounting surface is formed so as to be a part of the guide inclined surface, and the rear end part of the conductive contact is buried inside the insulating housing having the guide inclined surface.

11. The electric connector according to claim 1, wherein the guide inclined surface extends in a direction of rising from the cable mounting surface so as to form a flat-shaped or concave-shaped curved surface.

12. The electric connector according to claim 1, wherein the guide inclined surface is continuously provided with an introduction guide surface rising from an end edge part of the guide inclined surface in a direction approximately perpendicular to the cable mounting surface.

13. The electric connector according to claim 1, wherein the cable-shaped signal transmission medium is formed of a twin coaxial cable with a set of two fine-line cables being taken as one cable, and the contact engaging part is provided with a separation guide piece for guiding each of the set of two fine-line cables in a branching manner toward each of the adjacent conductive contact, the separation guide piece extending in the extending direction of the conductive contact.

14. A method of manufacturing an electric connector in which a conductive contact buried so as to be exposed to a surface of an insulating housing is disposed so as to extend from a rear end portion where a terminal part of a cable-shaped signal transmission medium is coupled to a front end portion toward a fitting-in counterpart connector side, the method of forming a contact engaging part covering both side parts corresponding to an edge of a region in a width direction perpendicular to an extending direction of the conductive contact, the method comprising the steps of forming a terminal edge part at the rear end portion of the conductive contact in the extending direction, with a dimension in the width direction being narrowed and forming in advance a terminal width representing a width-direction dimension of the terminal edge part so that the terminal width is shorter than a minimum width between the contact engaging parts that are adjacent in a pair in the width direction, burying the conductive contact in the insulating housing, with the terminal edge part of the conductive contact with narrowed terminal width being disposed along a length of the contact engaging part, wherein the terminal edge part of the conductive contact is disposed at a position drawn from the rear end part of the contact engaging part to a slightly forward side; and then cutting the conductive contact at the terminal edge part.

* * * * *